US009797226B2

(12) United States Patent
Yeh et al.

(10) Patent No.: US 9,797,226 B2
(45) Date of Patent: Oct. 24, 2017

(54) CROSSOVER JOINT FOR CONNECTING ECCENTRIC FLOW PATHS TO CONCENTRIC FLOW PATHS

(75) Inventors: Charles S. Yeh, Spring, TX (US); Michael D. Barry, The Woodlands, TX (US); Michael T. Hecker, Tomball, TX (US); Tracy J. Moffett, Sugar Land, TX (US); Pavlin B. Entchev, Moscow (RU); Patrick C. Hyde, Hurst, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 671 days.

(21) Appl. No.: 13/990,804

(22) PCT Filed: Nov. 17, 2011

(86) PCT No.: PCT/US2011/061220

§ 371 (c)(1),
(2), (4) Date: May 31, 2013

(87) PCT Pub. No.: WO2012/082301

PCT Pub. Date: Jun. 21, 2012

(65) Prior Publication Data

US 2013/0255943 A1 Oct. 3, 2013

Related U.S. Application Data

(60) Provisional application No. 61/424,427, filed on Dec. 17, 2010, provisional application No. 61/499,865, filed on Jun. 22, 2011.

(51) Int. Cl.
*E21B 43/04* (2006.01)
*E21B 17/18* (2006.01)

(52) U.S. Cl.
CPC ..... *E21B 43/045* (2013.01); *E21B 17/18* (2013.01)

(58) Field of Classification Search
CPC ..... E21B 43/04; E21B 17/18; E21B 21/12; E21B 43/045
See application file for complete search history.

(56) References Cited

U.S. PATENT DOCUMENTS 4,274,497 A * 6/1981 Willis ..... E21B 21/12 175/100
4,945,991 A 8/1990 Jones
(Continued)

OTHER PUBLICATIONS

Barry, M. D., et al., (2007), "Openhole Gravel Packing with Zonal Isolation," SPE-110460, *SPE Annual Technical Conference and Exhibition*, pp. 1-10.

(Continued)

*Primary Examiner* — Jennifer H Gay
(74) *Attorney, Agent, or Firm* — ExxonMobil Upstream Research Company Law Department

(57) ABSTRACT

A wellbore apparatus and method comprising a first wellbore tool having a primary flow path and at least one secondary flow path and a second wellbore tool having a primary flow path and secondary flow path. A radial center of the primary flow path in the first wellbore tool is offset from a radial center of the primary flow path in the second wellbore tool which comprises a crossover joint connecting the first wellbore tool to the second wellbore tool having a primary flow path fluidly connecting the primary flow path of the first wellbore tool to the primary flow path of the second wellbore tool, and at least one secondary flow path fluidly connecting the at least one secondary flow path of the first wellbore tool to the at least one secondary flow path of the second wellbore tool.

52 Claims, 17 Drawing Sheets

(56) References Cited

U.S. PATENT DOCUMENTS 5,113,935 A 5/1992 Jones et al.
5,348,091 A 9/1994 Tchakarov et al.
5,390,966 A 2/1995 Cox et al.
5,396,954 A 3/1995 Brooks
5,476,143 A 12/1995 Sparlin et al.
5,588,487 A 12/1996 Bryant
5,636,689 A 6/1997 Rubbo et al.
5,803,177 A * 9/1998 Hriscu ..... E21B 33/126 166/142
5,868,200 A 2/1999 Bryant et al.
5,887,660 A 3/1999 Yokley et al.
5,909,774 A 6/1999 Griffith et al.
5,975,205 A 11/1999 Carisella
6,003,834 A 12/1999 Read
6,179,056 B1 1/2001 Smith
6,298,916 B1 10/2001 Tibbles et al.
6,325,144 B1 12/2001 Turley et al.
6,354,378 B1 3/2002 Patel
6,409,219 B1 6/2002 Broome et al.
6,464,261 B1 10/2002 Dybevik et al.
6,513,599 B1 2/2003 Bixenman et al.
6,516,881 B2 2/2003 Hailey, Jr.
6,520,254 B2 2/2003 Hurst et al.
6,557,634 B2 5/2003 Hailey, Jr. et al.
6,575,251 B2 6/2003 Watson et al.
6,581,689 B2 6/2003 Hailey, Jr.
6,588,506 B2 * 7/2003 Jones ..... E21B 43/08 166/276
6,601,646 B2 8/2003 Streich et al.
6,644,404 B2 11/2003 Schultz et al.
6,666,274 B2 12/2003 Hughes
6,695,067 B2 2/2004 Johnson et al.
6,705,402 B2 3/2004 Proctor
6,749,023 B2 6/2004 Nguyen et al.
6,749,024 B2 6/2004 Bixenman
6,752,206 B2 6/2004 Watson et al.
6,752,207 B2 6/2004 Danos et al.
6,755,245 B2 6/2004 Nguyen et al.
6,789,621 B2 9/2004 Wetzel et al.
6,789,623 B2 9/2004 Hill, Jr. et al.
6,789,624 B2 9/2004 McGregor et al.
6,814,139 B2 11/2004 Hejl et al.
6,817,410 B2 11/2004 Wetzel et al.
6,830,104 B2 12/2004 Nguyen et al.
6,883,608 B2 4/2005 Parlar et al.
6,923,262 B2 8/2005 Broome et al.
6,935,432 B2 8/2005 Nguyen
6,983,796 B2 1/2006 Bayne et al.
6,986,390 B2 1/2006 Doanne et al.
6,997,263 B2 2/2006 Campbell et al.
7,044,231 B2 5/2006 Doane et al.
7,048,061 B2 5/2006 Bode et al.
7,051,805 B2 5/2006 Doane et al.
7,055,598 B2 6/2006 Ross et al.
7,096,945 B2 8/2006 Richards et al.
7,100,691 B2 9/2006 Nguyen et al.
7,104,324 B2 9/2006 Wetzel et al.
7,147,054 B2 12/2006 Wang et al.
7,152,677 B2 12/2006 Parlar et al.
7,207,383 B2 4/2007 Hurst et al.
7,222,676 B2 5/2007 Patel et al.
7,243,715 B2 7/2007 Wang et al.
7,243,723 B2 7/2007 Surjaatmadja et al.
7,243,724 B2 7/2007 McGregor et al.
7,243,732 B2 7/2007 Richard
7,252,142 B2 8/2007 Brezinski et al.
7,264,061 B2 9/2007 Dybevik et al.
7,278,479 B2 10/2007 Kvernstuen et al.
7,343,983 B2 3/2008 Livingstone
7,363,974 B2 4/2008 Wang et al.
7,367,395 B2 5/2008 Vidrine et al.
7,370,700 B2 5/2008 Hurst et al.
7,373,978 B2 5/2008 Barry et al.
7,392,852 B2 7/2008 Richard
7,407,007 B2 8/2008 Tibbles
7,426,962 B2 9/2008 Moen et al.
7,431,058 B2 10/2008 Holting
7,431,085 B2 10/2008 Coronado et al.
7,431,091 B2 10/2008 Themig et al.
7,431,098 B2 10/2008 Ohmer et al.
7,441,605 B2 10/2008 Coronado et al.
7,493,959 B2 2/2009 Johnson et al.
7,497,267 B2 3/2009 Setterberg, Jr. et al.
7,562,709 B2 7/2009 Saebi et al.
7,584,799 B2 9/2009 Coronado et al.
7,591,321 B2 9/2009 Whitsitt et al.
7,597,141 B2 10/2009 Rouse et al.
7,624,810 B2 12/2009 Fould et al.
7,661,476 B2 2/2010 Yeh et al.
7,681,652 B2 3/2010 Gaudette et al.
7,735,559 B2 6/2010 Malone
7,828,056 B2 11/2010 Dybevik et al.
7,832,472 B2 11/2010 Themig
7,886,819 B2 2/2011 Setterberg, Jr. et al.
7,938,184 B2 5/2011 Yeh et al.
7,971,642 B2 7/2011 Yeh et al.
8,215,406 B2 7/2012 Dale et al.
2003/0127227 A1 7/2003 Fehr et al.
2003/0173075 A1 9/2003 Morvant et al.
2004/0007829 A1 1/2004 Ross
2004/0140089 A1 7/2004 Gunneroed
2005/0028977 A1 2/2005 Ward
2005/0039917 A1 2/2005 Hailey, Jr.
2005/0061501 A1 3/2005 Ward et al.
2005/0082060 A1 4/2005 Ward et al.
2005/0241855 A1 11/2005 Wylie et al.
2005/0263287 A1 12/2005 Achee, Jr. et al.
2007/0056750 A1 3/2007 John et al.
2008/0125335 A1 5/2008 Bhavsar
2008/0128126 A1 6/2008 Dagenais et al.
2008/0142222 A1 6/2008 Howard et al.
2008/0314589 A1 12/2008 Guignard et al.
2009/0008084 A1 1/2009 Dybevik et al.
2009/0084556 A1 4/2009 Richards et al.
2009/0159279 A1 6/2009 Assal
2009/0159298 A1 6/2009 Assal
2009/0283279 A1 11/2009 Patel et al.
2009/0308592 A1 12/2009 Mercer et al.
2010/0032158 A1 2/2010 Dale et al.
2010/0065284 A1 3/2010 Freyer
2010/0096119 A1 4/2010 Sevre et al.
2010/0147538 A1 6/2010 Gaudette et al.
2010/0155064 A1 6/2010 Nutley et al.
2010/0218948 A1 9/2010 Mickelburgh et al.
2010/0252252 A1 10/2010 Harris et al.
2011/0042106 A1 2/2011 MacLeod
2011/0284208 A1 11/2011 MacLeod et al.
2012/0018153 A1 1/2012 Yeh et al.

OTHER PUBLICATIONS

Hecker, M. T., et al., (2004), "Reducing Well Cost by Gravel Packing in Nonaqueous Fluid," SPE-90758, *SPE AnnualTechnical Conference and Exhibition*, pp. 1-7.

Hecker, M. T., et al., (2010), Extending Openhole Gravel Packing Capability: Initial Field Installation of Internal Shunt Alternate Path Technology, SPE-135102, *SPE AnnualTechnical Conference and Exhibition*, pp. 1-6.

Hurst, G., et al., (2004), "Alternate Path Completions: A Critical Review and Lessons Learned From Case Histories With Recommended Practices for Deepwater Applications", SPE-86532, *SPE Internatinal Symposium and Exhibition*, pp. 1-14.

* cited by examiner

CROSSOVER JOINT FOR CONNECTING ECCENTRIC FLOW PATHS TO CONCENTRIC FLOW PATHS

CROSS REFERENCE TO RELATED APPLICATIONS

This application is the National Stage of International Application No. PCT/US11/61220, filed Nov. 17, 2011, which claims the benefit of U.S. Provisional Application No. 61/424,427, filed Dec. 17, 2010 and U.S. Provisional Application 61/499,865, filed Jun. 22, 2011, the entirety of which is incorporated herein by reference for all purposes.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of well completions. More specifically, the present invention relates to the completion of wellbores using sand screens and gravel packs. The application also relates to a downhole tool that may be used to connect eccentric flow paths to concentric flow paths for the installation of a gravel pack.

DISCUSSION OF TECHNOLOGY

In the drilling of oil and gas wells, a wellbore is formed using a drill bit that is urged downwardly at a lower end of a drill string. After drilling to a predetermined depth, the drill string and bit are removed and the wellbore is lined with a string of casing. An annular area is thus formed between the string of casing and the formation. A cementing operation is typically conducted in order to fill or "squeeze" the annular area with cement. The combination of cement and casing strengthens the wellbore and facilitates the isolation of the formation behind the casing.

It is common to place several strings of casing having progressively smaller outer diameters into the wellbore. The process of drilling and then cementing progressively smaller strings of casing is repeated several times until the well has reached total depth. The final string of casing, referred to as a production casing, is cemented in place and perforated. In some instances, the final string of casing is a liner, that is, a string of casing that is not tied back to the surface.

As part of the completion process, a wellhead is installed at the surface. The wellhead controls the flow of production fluids to the surface, or the injection of fluids into the wellbore. Fluid gathering and processing equipment such as pipes, valves and separators are also provided. Production operations may then commence.

In some instances, a wellbore is completed in a formation that is loose or "unconsolidated." This means that as production fluids are produced into the wellbore, formation particles, e.g., sand and fines, may also invade the wellbore. Such particles are detrimental to production equipment. More specifically, formation particles can be erosive to downhole pumps as well as to pipes, valves, and fluid separation equipment at the surface.

The problem of unconsolidated formations can occur in connection with the completion of a cased wellbore. In that instance, formation particles may invade the perforations created through production casing and a surrounding cement sheath. However, the problem of unconsolidated formations is much more pronounced when a wellbore is formed as an "open hole" completion.

In an open-hole completion, a production casing is not extended through the producing zones and perforated; rather, the producing zones are left uncased, or "open." A production string or "tubing" is then positioned inside the wellbore extending down below the last string of casing and across a subsurface formation.

There are certain advantages to open-hole completions versus cased-hole completions. First, because open-hole completions have no perforation tunnels, formation fluids can converge on the wellbore radially 360 degrees. This has the benefit of eliminating the additional pressure drop associated with converging radial flow and then linear flow through particle-filled perforation tunnels. The reduced pressure drop associated with an open-hole completion virtually guarantees that it will be more productive than an unstimulated, cased hole in the same formation. Second, open-hole techniques are oftentimes less expensive than cased hole completions.

A common problem in open-hole completions is the immediate exposure of the wellbore to the surrounding formation. If the formation is unconsolidated or heavily sandy, the flow of production fluids into the wellbore may carry with it formation particles, e.g., sand and fines. Such particles can be erosive to production equipment downhole and to pipes, valves and separation equipment at the surface.

To control the invasion of sand and other particles, sand control devices may be employed. Sand control devices are usually installed downhole across formations to retain solid materials larger than a certain diameter while allowing fluids to be produced. A sand control device typically includes an elongated tubular body, known as a base pipe, having numerous slotted openings. The base pipe is then typically wrapped with a filtration medium such as a screen or wire mesh.

To augment sand control devices, particularly in open-hole completions, it is common to install a gravel pack. Gravel packing a well involves placing gravel or other particulate matter around the sand control device after the sand control device is hung or otherwise placed in the wellbore. To install a gravel pack, a particulate material is delivered downhole by means of a carrier fluid. The carrier fluid with the gravel together forms a gravel slurry. The slurry dries in place, leaving a circumferential packing of gravel. The gravel not only aids in particle filtration but also helps maintain wellbore integrity. The use of gravel packs also eliminates the need for cementing, perforating, and post-perforation clean-up operations.

In an open-hole gravel pack completion, the gravel is positioned between a sand screen that surrounds a perforated base pipe and a surrounding wall of the wellbore. During production, formation fluids flow from the subterranean formation, through the gravel, through the screen, and into the inner base pipe. The base pipe thus serves as a part of the production string.

A problem historically encountered with gravel-packing is that an inadvertent loss of carrier fluid from the slurry during the delivery process can result in premature sand or gravel bridges being formed at various locations along open-hole intervals. For example, in an inclined production interval or an interval having an enlarged or irregular borehole, a poor distribution of gravel may occur due to a premature loss of carrier fluid from the gravel slurry into the formation. Premature sand bridging can block the flow of gravel slurry, causing voids to form along the completion interval. Thus, a complete gravel-pack from bottom to top is not achieved, leaving the wellbore exposed to sand and fines infiltration.

The problem of sand bridging has been addressed through the use of Alternate Path® Technology, or "APT." The Alternate Path® fluid bypass technology employs shunt tubes (or shunts) that allow the gravel slurry to bypass selected areas along a wellbore. Such fluid bypass technology is described, for example, in U.S. Pat. No. 5,588,487 entitled "Tool for Blocking Axial Flow in Gravel-Packed Well Annulus," and PCT Publication No. WO 2008/060479 entitled "Wellbore Method and Apparatus for Completion, Production, and Injection," each of which is incorporated herein by reference in its entirety. Additional references which discuss fluid bypass technology include U.S. Pat. No. 4,945,991; U.S. Pat. No. 5,113,935; U.S. Pat. No. 7,661,476; and M. D. Barry, et al., "Open-hole Gravel Packing with Zonal Isolation," SPE Paper No. 110,460 (November 2007).

It is known to use rectangular shunt tubes that are eccentrically attached to the outside of a sand screen. Schlumberger's OptiPac™ fluid bypass gravel pack system is an example of a sand screen having external shunt tubes and one or more external transport tubes. See also G. Hurst, et al., S. Tocalino, "*Alternate Path Completions: A Critical Review and Lessons Learned From Case Histories With Recommended Practices for Deepwater Applications*," SPE Paper No. 86,532 (2004). The eccentric layout reduces the overall diametrical size of the tool compared to if the equivalent shunt tubes were attached concentrically.

Recent technological advances have led to the development of two new downhole tools useful for the installation of a gravel pack. The first is an Alternate Path® sand screen having concentric internal shunt tubes. Embodiments of such a sand screen are shown and described in M. T. Hecker, et al., "*Extending Openhole Gravel-Packing Capability: Initial Field Installation of Internal Shunt Alternate Path Technology*," SPE Paper No. 135,102 (2010); and in U.S. Patent Publ. No. 2008/0142227 filed in 2008 and entitled "*Wellbore Method and Apparatus for Completion, Production and Injection*." The second is a concentric, internal-shunt open-hole packer. Embodiments of such a packer are shown and described in U.S. Provisional Patent Application No. 61/424,427 filed 17 Dec. 2010. That application is entitled "*Packer for Alternate Path Gravel Packing, and Method for Completing a Wellbore*." The combination of these tools enables a true zonal isolation in gravel pack completions.

It is desirable to be able to connect a first wellbore tool (such as the OptiPac™ sand screen) that presents eccentric flow paths, with a second wellbore tool (such as an internal-shunt screen or internal shunt open-hole packer) that provides concentric flow paths. Alternatively, it is desirable to connect a first wellbore tool (such as an Alternate Path® sand screen having concentric internal shunt tubes) with a blank pipe or packer having eccentric flow paths and shunt tubes. Alternatively still, it desirable to connect to joints of sand screen, wherein one joint has a concentric primary flow path, and another has an eccentric primary flow path.

Various connectors have been disclosed either between concentric flow paths or between eccentric flow paths. Such connectors are at least mentioned in, for example, U.S. Pat. No. 7,497,267; U.S. Pat. No. 7,886,819; U.S. Pat. No. 5,390,966, U.S. Pat. No. 5,868,200, U.S. Pat. No. 6,409,219, U.S. Pat. No. 6,520,254, U.S. Pat. No. 6,752,207, U.S. Pat. No. 6,789,621, U.S. Pat. No. 6,789,624, U.S. Pat. No. 6,814,139, U.S. Pat. No. 6,923,262, U.S. Pat. No. 7,048,061, US2008/0142227, U.S. Pat. No. 7,661,476, U.S. Pat. No. 7,828,056). They provide fluid communication between eccentric primary flow paths, between concentric primary flow paths, between eccentric secondary flow paths, or between concentric secondary flow paths. However, a crossover tool connecting concentric flow paths to eccentric flow paths (or vice versa) between two screen joints or between a screen joint and a packer has not yet been developed.

Therefore, a need exists for an improved sand control system utilizing a crossover joint for connecting an eccentric sand screen with a concentric packer, or vice versa. A need further exists for a crossover tool that fluidly connects a first wellbore tool having a primary flow path and at least one secondary flow path, with a second wellbore tool also having a primary flow path and at least one secondary flow path, wherein a radial center of the primary flow path in the first wellbore tool is offset from a radial center of the primary flow path in the second wellbore tool.

SUMMARY OF THE INVENTION

A sand control system is first provided herein. The sand control system includes a first wellbore tool having a primary flow path and at least one secondary flow path. The sand control system also includes a second wellbore tool, with the second wellbore tool also having a primary flow path and at least one secondary flow path. A radial center of the primary flow path in the first wellbore tool is offset from a radial center of the primary flow path in the second wellbore tool.

The sand control system also has a crossover joint. The crossover joint connects the first wellbore tool to the second wellbore tool. The crossover joint comprises a primary flow path fluidly connecting the primary flow path of the first wellbore tool to the primary flow path of the second wellbore tool. The crossover joint also has at least one secondary flow path fluidly connecting the at least one secondary flow path of the first wellbore tool to the at least one secondary flow path of the second wellbore tool.

In one preferred embodiment of the sand control system, the first wellbore tool is a sand screen. The sand screen comprises an elongated base pipe, a filtering medium circumferentially around the base pipe, and at least one shunt tube along the base pipe. The shunt tube serves as an alternate flow channel. In this respect, the shunt tube is configured to allow gravel slurry to at least partially bypass the first wellbore tool when any premature sand bridge occurs in the surrounding annular region between the sand screen and the wellbore during a gravel-packing operation in the wellbore. In this instance, the base pipe serves as the primary flow path of the sand screen, and the at least one shunt tube serves as the at least one secondary flow path of the sand screen.

In the sand screen, the elongated base pipe is preferably eccentric to the sand screen. Each of the at least one shunt tube then may have a round profile, a square profile, or a rectangular profile.

In another preferred embodiment of the sand control system, the second wellbore tool is a packer. The packer comprises an elongated inner mandrel, a sealing element external to the inner mandrel, and an annulus serving as an alternate flow channel. The annulus is configured to allow gravel slurry to at least partially bypass the second wellbore tool during a gravel-packing operation in a wellbore after the packer has been set in the wellbore. In this instance, the inner mandrel serves as the primary flow path of the packer, and the annulus serves as the at least one secondary flow path of the packer.

In the packer, the inner mandrel is preferably concentric to the packer. Further, the annulus resides between the inner mandrel and a surrounding piston housing. The packer further has one or more flow ports providing fluid communication between the annulus and a pressure-bearing surface of the piston housing.

A crossover joint for connecting a first wellbore tool to a second wellbore tool is also provided herein. The crossover joint is configured in accordance with the crossover joint described above. The crossover joint may be used as part of a sand control system. However, the crossover joint may be used to connect any two tubular tools having primary flow paths and secondary flow paths, wherein a radial center of the primary flow path in the first wellbore tool is offset from a radial center of the primary flow path in the second wellbore tool.

In one embodiment, the primary flow path of the first wellbore tool is eccentric to the first wellbore tool, while the primary flow path of the second wellbore tool is concentric to the second wellbore tool. The first wellbore tool is preferably a sand screen, while the second wellbore tool is preferably a mechanically-set packer.

A base pipe serves as the primary flow path of the sand screen, while an elongated inner mandrel serves as the primary flow path of the packer. The secondary flow path for the sand screen is made up of shunt tubes which serve as alternate flow channels. The secondary flow path for the packer may be shunt tubes or may be an annulus formed between the inner mandrel and a surrounding moveable piston housing. The alternate flow channels allow a gravel slurry to bypass the sand screen joint, the crossover joint, and the packer, even after the packer has been set in the wellbore.

The at least one secondary flow path of the crossover joint changes direction along a longitudinal axis of the crossover joint at least once. In one aspect, an inner diameter of the primary flow path of the crossover joint is greater than an inner diameter of (i) the primary flow path of the first wellbore tool, (ii) the primary flow path of the second wellbore tool, or (iii) both.

The crossover joint may optionally include an outer protective shroud.

A method for completing a wellbore in a subsurface formation is also provided herein. In one aspect, the method comprises providing a first wellbore tool. The first wellbore tool has a primary flow path and at least one secondary flow path. The method also includes providing a second wellbore tool. The second wellbore tool also has a primary flow path and at least one secondary flow path. A radial center of the primary flow path of the first wellbore tool is offset from a radial center of the primary flow path for the second wellbore tool.

The method also includes providing a crossover joint. The crossover joint also comprises a primary flow path and a secondary flow path. The method then includes fluidly connecting the crossover joint to the first wellbore tool at a first end, and fluidly connecting the crossover joint to the second wellbore tool at a second end. In this manner, the primary flow path of the first wellbore tool is in fluid communication with the primary flow path of the second wellbore tool. Further, the at least one secondary flow path of the first wellbore tool is in fluid communication with the at least one secondary flow path of the second wellbore tool.

The method further includes running the crossover joint and connected first and second wellbore tools into a wellbore to a selected subsurface location. Fluid is then injected into an annular region between the crossover joint and the surrounding wellbore. The method then includes further injecting the fluid from the annulus and through the secondary flow paths of the first wellbore tool, the crossover joint, and the secondary flow paths of the second wellbore tool.

The crossover joint may be used to connect any two tubular tools having primary flow paths and secondary flow paths, wherein a radial center of the primary flow path in the first wellbore tool is offset from a radial center of the primary flow path in the second wellbore tool. However, it is preferred that the crossover joint be used as part of a sand control system. In this instance, the first wellbore tool is preferably a sand screen, while the second wellbore tool is preferably a settable packer.

In one embodiment, the primary flow path of the first wellbore tool (such as a sand screen) is eccentric to the first wellbore tool, while the primary flow path of the second wellbore tool (such as a packer) is concentric to the second wellbore tool.

A base pipe serves as the primary flow path of the sand screen, while an elongated inner mandrel serves as the primary flow path of the packer. The secondary flow path for the sand screen is made up of shunt tubes which serve as alternate flow channels. The secondary flow path for the packer may be shunt tubes or may be an annular area formed between the inner mandrel and a surrounding moveable piston housing. In any instance, the alternate flow channels allow a gravel slurry to bypass the sand screen joint, the crossover joint, and the packer, even after the packer has been set in the wellbore.

In one aspect, the method further comprises setting the packer in the wellbore. In this instance, the step of further injecting the fluid through the secondary flow paths is done after the packer has been set.

In another aspect, the method further comprises running a setting tool into the inner mandrel of the packer, and then pulling the setting tool to mechanically shift a release sleeve from a retained position along the inner mandrel of the packer. This serves to release the piston housing for axial movement. The method then includes communicating hydrostatic pressure to the piston housing through one or more flow ports, thereby axially moving the released piston housing and actuating the sealing element against the surrounding wellbore.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 11A also charts curvature (second y-axis) against symmetric length of a crossover joint (x-axis) for the 16-foot crossover joint.

FIG. 11B also charts curvature (second y-axis) against symmetric length of a crossover joint (x-axis) for the 8-foot crossover joint.

FIG. 13 shows steps for a method of setting a packer in a wellbore, in one embodiment.

DETAILED DESCRIPTION OF CERTAIN EMBODIMENTS

Definitions

Figure 1:
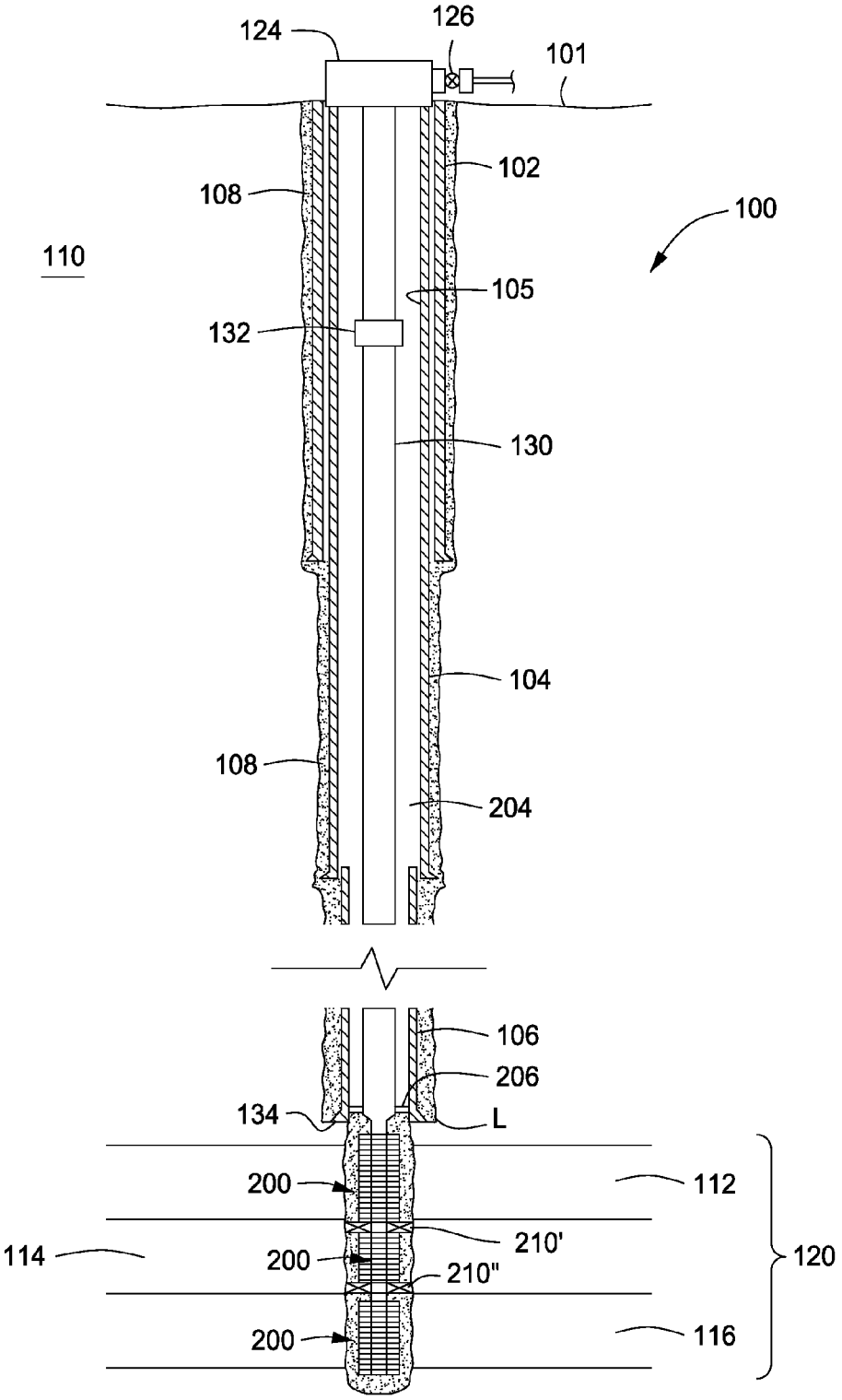
FIG. 1 is a cross-sectional view of an illustrative wellbore. The wellbore has been drilled through three different subsurface intervals, each interval being under formation pressure and containing fluids.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "fluid" refers to gases, liquids, and combinations of gases and liquids, as well as to combinations of gases and solids, and combinations of liquids and solids.

As used herein, the term "subsurface" refers to geologic strata occurring below the earth's surface.

The term "subsurface interval" refers to a formation or a portion of a formation wherein formation fluids may reside. The fluids may be, for example, hydrocarbon liquids, hydrocarbon gases, aqueous fluids, or combinations thereof.

As used herein, the term "wellbore" refers to a hole in the subsurface made by drilling or insertion of a conduit into the subsurface. A wellbore may have a substantially circular cross section, or other cross-sectional shape. As used herein, the term "well", when referring to an opening in the formation, may be used interchangeably with the term "wellbore."

The term "tubular member" refers to any pipe, such as a joint of casing, a portion of a liner, or a pup joint.

The term "sand control device" means any elongated tubular body that permits an inflow of fluid into an inner bore or a base pipe while filtering out predetermined sizes of sand, fines and granular debris from a surrounding formation. A sand screen is an example of a sand control device.

The term "alternate flow channels" means any collection of manifolds and/or shunt tubes that provide fluid communication through or around a packer to allow a gravel slurry to by-pass the packer elements or any premature sand bridge in the annular region, and to continue gravel packing further downstream. The term "alternate flow channels" can also mean any collection of manifolds and/or shunt tubes that provide fluid communication through or around a sand screen or a blank pipe (with or without outer protective shroud) to allow a gravel slurry to by-pass any premature sand bridge in the annular region and continue gravel packing below, or above and below, the downhole tool.

Description of Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

Certain aspects of the inventions are also described in connection with various figures. In certain of the figures, the top of the drawing page is intended to be toward the surface, and the bottom of the drawing page toward the well bottom. While wells commonly are completed in substantially vertical orientation, it is understood that wells may also be inclined and or even horizontally completed. When the descriptive terms "up and down" or "upper" and "lower" or similar terms are used in reference to a drawing or in the claims, they are intended to indicate relative location on the drawing page or with respect to claim terms, and not necessarily orientation in the ground, as the present inventions have utility no matter how the wellbore is orientated.

FIG. 1 is a cross-sectional view of an illustrative wellbore 100. The wellbore 100 defines a bore 105 that extends from a surface 101, and into the earth's subsurface 110. The wellbore 100 is completed to have an open-hole portion 120 at a lower end of the wellbore 100. The wellbore 100 has been formed for the purpose of producing hydrocarbons for commercial sale. A string of production tubing 130 is provided in the bore 105 to transport production fluids from the open-hole portion 120 up to the surface 101.

The wellbore 100 includes a well tree, shown schematically at 124. The well tree 124 includes a shut-in valve 126. The shut-in valve 126 controls the flow of production fluids from the wellbore 100. In addition, a subsurface safety valve 132 is provided to block the flow of fluids from the production tubing 130 in the event of a rupture or catastrophic event above the subsurface safety valve 132. The wellbore 100 may optionally have a pump (not shown) within or just above the open-hole portion 120 to artificially lift production fluids from the open-hole portion 120 up to the well tree 124.

The wellbore 100 has been completed by setting a series of pipes into the subsurface 110. These pipes include a first string of casing 102, sometimes known as surface casing or a conductor. These pipes also include at least a second 104 and a third 106 string of casing. These casing strings 104, 106 are intermediate casing strings that provide support for walls of the wellbore 100. Intermediate casing strings 104, 106 may be hung from the surface, or they may be hung from a next higher casing string using an expandable liner or liner hanger. It is understood that a pipe string that does not extend back to the surface (such as casing string 106) is normally referred to as a "liner."

In the illustrative wellbore arrangement of FIG. 1, intermediate casing string 104 is hung from the surface 101, while casing string 106 is hung from a lower end of casing string 104. Additional intermediate casing strings (not shown) may be employed. The present inventions are not limited to the type of casing arrangement used.

Each string of casing 102, 104, 106 is set in place through cement 108. The cement 108 isolates the various formations of the subsurface 110 from the wellbore 100 and each other. The cement 108 extends from the surface 101 to a depth "L" at a lower end of the casing string 106. It is understood that some intermediate casing strings may not be fully cemented.

An annular region 204 is formed between the production tubing 130 and the casing string 106. A production packer 206 seals the annular region 204 near the lower end "L" of the casing string 106.

In many wellbores, a final casing string known as production casing is cemented into place at a depth where subsurface production intervals reside. However, the illustrative wellbore 100 is completed as an open-hole wellbore. Accordingly, the wellbore 100 does not include a final casing string along the open-hole portion 120.

In the illustrative wellbore 100, the open-hole portion 120 traverses three different subsurface intervals. These are indicated as upper interval 112, intermediate interval 114, and lower interval 116. Upper interval 112 and lower interval 116 may, for example, contain valuable oil deposits sought to be produced, while intermediate interval 114 may contain primarily water or other aqueous fluid within its pore volume. This may be due to the presence of native water zones, high permeability streaks or natural fractures in the aquifer, or fingering from injection wells. In this instance, there is a probability that water will invade the wellbore 100.

Alternatively, upper 112 and intermediate 114 intervals may contain hydrocarbon fluids sought to be produced, processed and sold, while lower interval 116 may contain some oil along with ever-increasing amounts of water. This may be due to coning, which is a rise of near-well hydrocarbon-water contact. In this instance, there is again the possibility that water will invade the wellbore 100.

Alternatively still, upper 112 and lower 116 intervals may be producing hydrocarbon fluids from a sand or other permeable rock matrix, while intermediate interval 114 may represent a non-permeable shale or otherwise be substantially impermeable to fluids.

In any of these events, it is desirable for the operator to isolate selected intervals. In the first instance, the operator will want to isolate the intermediate interval 114 from the production string 130 and from the upper 112 and lower 116 intervals so that primarily hydrocarbon fluids may be produced through the wellbore 100 and to the surface 101. In the second instance, the operator will eventually want to isolate the lower interval 116 from the production string 130 and the upper 112 and intermediate 114 intervals so that primarily hydrocarbon fluids may be produced through the wellbore 100 and to the surface 101. In the third instance, the operator will want to isolate the upper interval 112 from the lower interval 116, but need not isolate the intermediate interval 114. Solutions to these needs in the context of an open-hole completion are provided herein, and are demonstrated more fully in connection with the proceeding drawings.

In connection with the production of hydrocarbon fluids from a wellbore having an open-hole completion, it is not only desirable to isolate selected intervals, but also to limit the influx of sand particles and other fines. In order to prevent the migration of formation particles into the production string 130 during operation, sand control devices 200 have been run into the wellbore 100. These are described more fully below in connection with FIG. 2.

Figure 2:
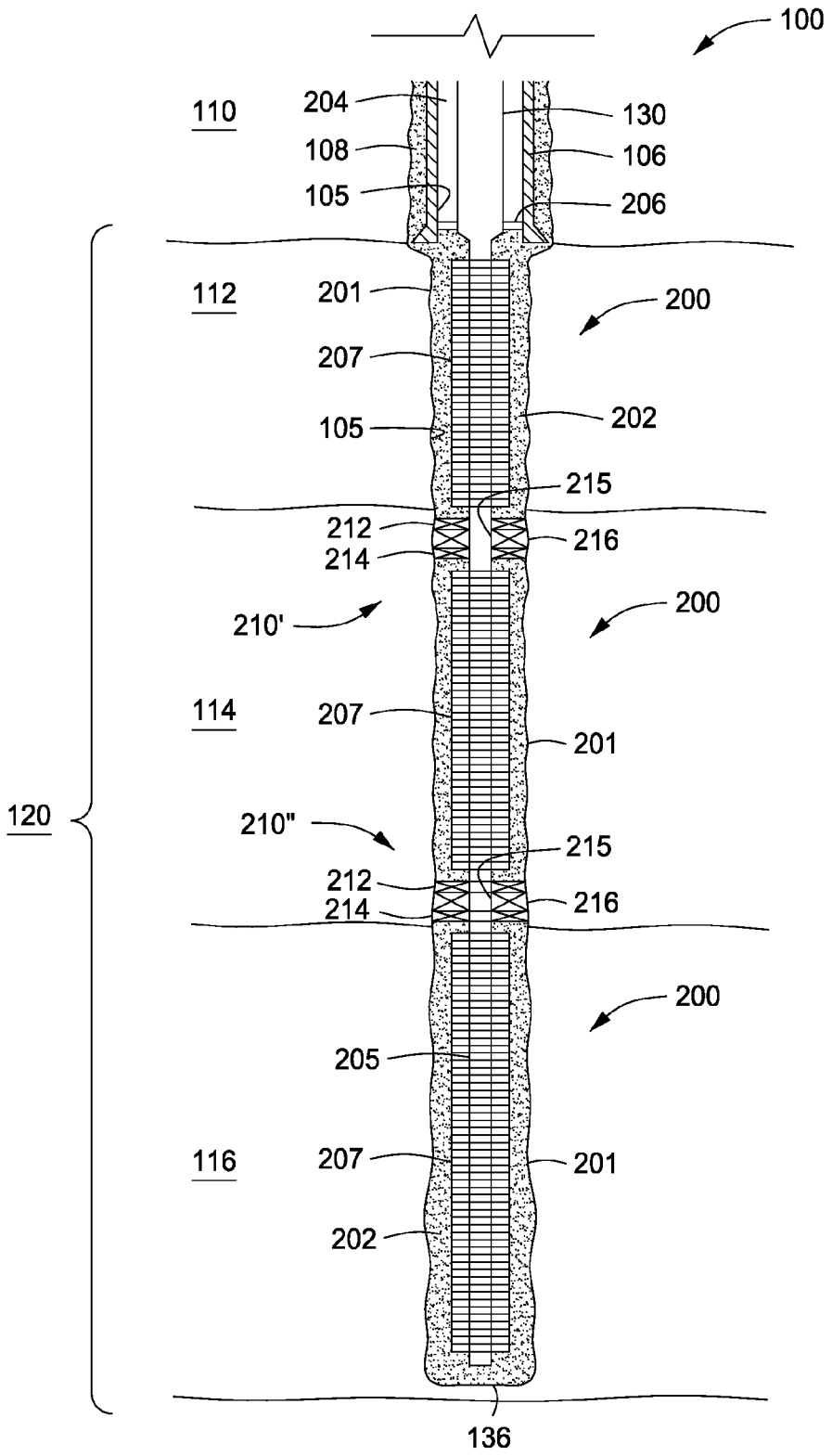
FIG. 2 is an enlarged cross-sectional view of an open-hole completion of the wellbore of FIG. 1. The open-hole completion at the depth of the three subsurface intervals is more clearly seen.

Referring now to FIG. 2, the sand control devices 200 contain an elongated tubular body referred to as a base pipe 205. The base pipe 205 typically is made up of a plurality of pipe joints. The base pipe 205 (or each pipe joint making up the base pipe 205) typically has small perforations or slots to permit the inflow of production fluids.

The sand control devices 200 also contain a filter medium 207 wound or otherwise placed radially around the base pipes 205. The filter medium 207 may be a wire mesh screen or wire wrap fitted around the base pipe 205. Alternatively, the filtering medium of the sand screen comprises a membrane screen, an expandable screen, a sintered metal screen, a porous media made of shape memory polymer, a porous media packed with fibrous material, or a pre-packed solid particle bed. The filter medium 207 prevents the inflow of sand or other particles above a pre-determined size into the base pipe 205 and the production tubing 130.

In addition to the sand control devices 200, the wellbore 100 includes one or more packer assemblies 210. In the illustrative arrangement of FIGS. 1 and 2, the wellbore 100 has an upper packer assembly 210' and a lower packer assembly 210". However, additional packer assemblies 210 or just one packer assembly 210 may be used. The packer assemblies 210', 210" are uniquely configured to seal an annular region (seen at 202 of FIG. 2) between the various sand control devices 200 and a surrounding wall 201 of the open-hole portion 120 of the wellbore 100.

The packer assemblies 210', 210" allow the operator to isolate selected intervals along the open-hole portion of the wellbore 100 in order to control the migration of formation fluids. For example, in connection with the production of condensable hydrocarbons, water may sometimes invade an interval. This may be due to the presence of native water zones, coning (rise of near-well hydrocarbon-water contact), high permeability streaks, natural fractures, or fingering from injection wells. Depending on the mechanism or cause of the water production, the water may be produced at different locations and times during a well's lifetime. Similarly, a gas cap above an oil reservoir may expand and break through, causing gas production with oil. The gas breakthrough reduces gas cap drive and suppresses oil production. Annular zonal isolation may also be desired for production allocation, production/injection fluid profile control, selective stimulation, or water or gas control.

FIG. 2 is an enlarged cross-sectional view of the open-hole portion 120 of the wellbore 100 of FIG. 1. The open-hole portion 120 and the three intervals 112, 114, 116 are more clearly seen. The upper 210' and lower 210" packer assemblies are also more clearly visible proximate upper and lower boundaries of the intermediate interval 114, respectively. Finally, the sand control devices 200 along each of the intervals 112, 114, 116 are shown.

Concerning the packer assemblies themselves, each packer assembly 210', 210" may have at least two packers. The two packers are preferably set through a combination of mechanical manipulation and hydraulic forces. The packer assemblies 210 represent an upper packer 212 and a lower packer 214. Each packer 212, 214 has an expandable portion or element fabricated from an elastomeric or a thermoplastic material capable of providing at least a temporary fluid seal against the surrounding wellbore wall 201.

The elements for the upper 212 and lower 214 packers should be able to withstand the pressures and loads associated with a gravel packing process. Typically, such pressures are from about 2,000 psi to 3,000 psi. The elements of the packers 212, 214 should also withstand pressure load due to differential wellbore and/or reservoir pressures caused by natural faults, depletion, production, or injection. Production operations may involve selective production or production allocation to meet regulatory requirements. Injection operations may involve selective fluid injection for strategic reservoir pressure maintenance. Injection operations may also involve selective stimulation in acid fracturing, matrix acidizing, or formation damage removal.

The sealing surface or elements for the mechanically set packers 212, 214 need only be on the order of inches to affect a suitable hydraulic seal. In one aspect, the elements are each about 6 inches (15.2 cm) to about 24 inches (61.0 cm) in length.

The elements for the packers 212, 214 are preferably cup-type elements. Cup-type elements are known for use in cased-hole completions. However, they generally are not known for use in open-hole completions as they are not engineered to expand into engagement with an open-hole diameter. Moreover, such expandable cup-type elements may not maintain the required pressure differential encountered over the life of production operations, resulting in decreased functionality.

It is preferred for the packers 212, 214 to be able to expand to at least an 11-inch (about 28 cm) outer diameter surface, with no more than a 1.1 ovality ratio. The elements of the packers 212, 214 should preferably be able to handle washouts in an 8½ inch (about 21.6 cm) or 9⅞ inch (about 25.1 cm) open-hole section 120. The preferred cup-type nature of the expandable portions of the packer elements 212, 214 will assist in maintaining at least a temporary seal against the wall 201 of the intermediate interval 114 (or other interval) as pressure increases during the gravel packing operation.

In one embodiment, the cup-type elements need not be liquid tight, nor must they be rated to handle multiple pressure and temperature cycles. The cup-type elements need only be designed for one-time use, to wit, during the gravel packing process of an open-hole wellbore completion. This is because an intermediate swellable packer element 216 is also preferably provided for long term sealing.

The upper 212 and lower 214 packers are set prior to a gravel pack installation process. As described more fully below, the packer 212, 214 may be set by mechanically shearing a shear pin and sliding a release sleeve. This, in turn, releases a release key, which then allows hydrostatic pressure to act downwardly against a piston housing. The piston housing travels downward along an inner mandrel (not shown), and then acts upon both a centralizer and/or packer elements along the inner mandrel. The centralizer and the packer elements expand against the wellbore wall 201. The expandable portions of the upper 212 and lower 214 packers are expanded into contact with the surrounding wall 201 so as to straddle the annular region 202 at a selected depth along the open-hole completion 120.

As a "back-up" to the cup-type packer elements within the upper 212 and lower 214 packer elements, the packer assemblies 210', 210" also each include an intermediate packer element 216. The intermediate packer element 216 defines a swelling elastomeric material fabricated from synthetic rubber compounds. Suitable examples of swellable materials may be found in Easy Well Solutions' CONSTRICTOR™ or SWELLPACKER™ and Swellfix's E-ZIP™. The swellable packer 216 may include a swellable polymer or swellable polymer material, which is known by those skilled in the art and which may be set by one of a conditioned drilling fluid, a completion fluid, a production fluid, an injection fluid, a stimulation fluid, or any combination thereof.

The swellable packer element 216 is preferably bonded to the outer surface of the mandrel 215. The swellable packer element 216 is allowed to expand over time when contacted by hydrocarbon fluids, formation water, or any chemical described above which may be used as an actuating fluid. As the packer element 216 expands, it forms a fluid seal with the surrounding zone, e.g., interval 114. In one aspect, a sealing surface of the swellable packet element 216 is from about 5 feet (1.5 meters) to 50 feet (15.2 meters) in length; and more preferably, about 3 feet (0.9 meters) to 40 feet (12.2 meters) in length.

The swellable packer element 216 must be able to expand to the wellbore wall 201 and provide the required pressure integrity at that expansion ratio. Since swellable packers are typically set in a shale section that may not produce hydrocarbon fluids, it is preferable to have a swelling elastomer or other material that can swell in the presence of formation water or an aqueous-based fluid. Examples of materials that will swell in the presence of an aqueous-based fluid are bentonite clay and a nitrile-based polymer with incorporated water absorbing particles.

Alternatively, the swellable packer element 216 may be fabricated from a combination of materials that swell in the presence of water and oil, respectively. Stated another way, the swellable packer element 216 may include two types of swelling elastomers—one for water and one for oil. In this situation, the water-swellable element will swell when exposed to the water-based gravel pack fluid or in contact with formation water, and the oil-based element will expand when exposed to hydrocarbon production. An example of an elastomeric material that will swell in the presence of a hydrocarbon liquid is oleophilic polymer that absorbs hydrocarbons into its matrix. The swelling occurs from the absorption of the hydrocarbons which also lubricates and decreases the mechanical strength of the polymer chain as it expands. Ethylene propylene diene monomer (M-class) rubber, or EPDM, is one example of such a material.

The swellable packer 216 may be fabricated from other expandable material. An example is a shape-memory polymer. U.S. Pat. No. 7,243,732 and U.S. Pat. No. 7,392,852 disclose the use of such a material for zonal isolation.

The mechanically set packer elements 212, 214 are preferably set in a water-based gravel pack fluid that would be diverted around the swellable packer element 216, such as through shunt tubes (not shown in FIG. 2). If only a hydrocarbon swelling elastomer is used, expansion of the element may not occur until after the failure of either of the mechanically set packer elements 212, 214.

The upper 212 and lower 214 packers are generally mirror images of each other, except for the release sleeves that shear the respective shear pins or other engagement mechanisms. Unilateral movement of a shifting tool (shown in and discussed in connection with FIGS. 7A and 7B) will allow the packers 212, 214 to be activated in sequence or simultaneously. The lower packer 214 is activated first, followed by the upper packer 212 as the shifting tool is pulled upward through an inner mandrel (shown in and discussed in connection with FIGS. 6A and 6B). A short spacing is preferably provided between the upper 212 and lower 214 packers.

The packer assemblies 210', 210" help control and manage fluids produced from different zones. In this respect, the packer assemblies 210', 210" allow the operator to seal off an interval from either production or injection, depending on well function. Installation of the packer assemblies 210', 210" in the initial completion allows an operator to shut-off the production from one or more zones during the well lifetime to limit the production of water or, in some instances, an undesirable non-condensable fluid such as hydrogen sulfide.

Packers historically have not been installed when an open-hole gravel pack is utilized because of the difficulty in forming a complete gravel pack above and below the packer. For example, see patent applications entitled "Wellbore Method and Apparatus for Completion, Production and Injection." The applications published on Aug. 16, 2007, as WO 2007/092082 and WO 2007/092083, respectively. The applications disclose apparatus' and methods for gravel-packing an open-hole wellbore. PCT Publication Nos. WO 2007/092082 and WO 2007/092083 are each incorporated herein by reference in their entireties.

Certain technical challenges have remained with respect to the methods disclosed in the incorporated PCT publications, particularly in connection with the packer. The applications state that the packer may be a hydraulically actuated inflatable element. Such an inflatable element may be fabricated from an elastomeric material or a thermoplastic material. However, designing a packer element from such materials requires the packer element to meet a particularly high performance level. In this respect, the packer element needs to be able to maintain zonal isolation for a period of years in the presence of high pressures and/or high temperatures and/or acidic fluids. As an alternative, the applications state that the packer may be a swelling rubber element that expands in the presence of hydrocarbons, water, or other stimulus. However, known swelling elastomers typically require about 30 days or longer to fully expand into sealed fluid engagement with the surrounding rock formation. Therefore, improved packers and zonal isolation apparatus' are offered herein.

Figure 3A:
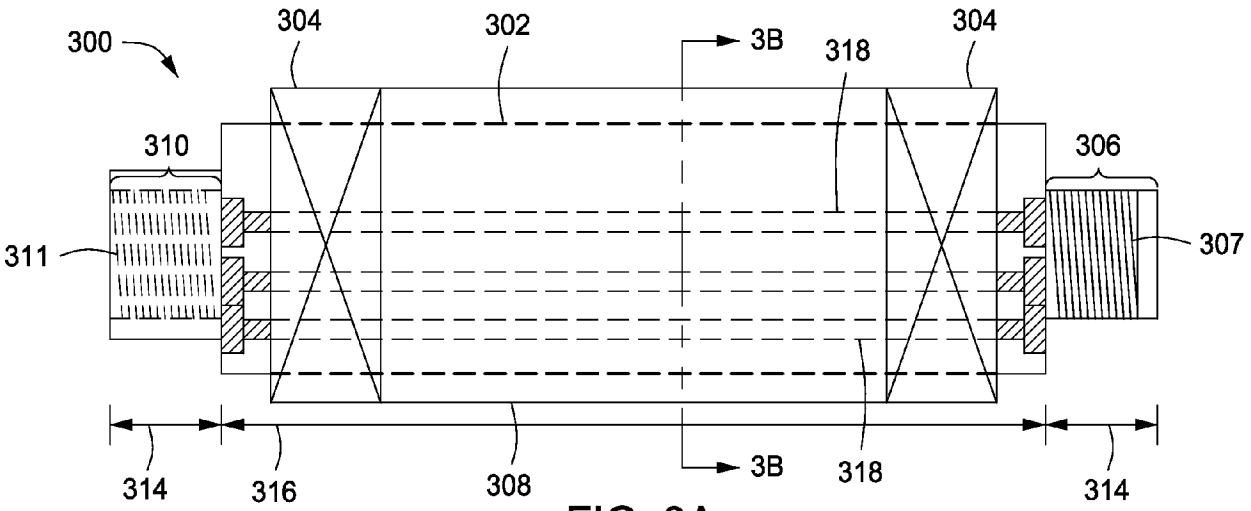
FIG. 3A is a cross-sectional side view of a packer assembly, in one embodiment. Here, a base pipe is shown, with surrounding packer elements. Two mechanically set packers are shown schematically, along with an intermediate swellable packer element.

FIG. 3A presents an illustrative packer assembly 300 providing an alternate flowpath for a gravel slurry. The packer assembly 300 is seen in cross-sectional side view. The packer assembly 300 includes various components that may be utilized to seal an annulus along the open-hole portion 120.

The packer assembly 300 first includes a main body section 302. The main body section 302 is preferably fabricated from steel or from steel alloys. The main body section 302 is configured to be a specific length 316, such as about 40 feet (12.2 meters). The main body section 302 comprises individual pipe joints that will have a length that is between about 10 feet (3.0 meters) and 50 feet (15.2 meters). The pipe joints are typically threadedly connected end-to-end to form the main body section 302 according to length 316.

The packer assembly 300 also includes opposing mechanically-set packers 304. The mechanically-set packers 304 are shown schematically, and are generally in accordance with mechanically-set packer elements 212 and 214 of FIG. 2. The packers 304 preferably include cup-type elastomeric elements that are less than 1 foot (0.3 meters) in length. As described further below, the packers 304 have alternate flow channels that uniquely allow the packers 304 to be set before a gravel slurry is circulated into the wellbore.

The packer assembly 300 also optionally includes a swellable packer 308. The swellable packer 308 is in accordance with swellable packer element 216 of FIG. 2. The swellable packer 308 is preferably about 3 feet (0.9 meters) to 40 feet (12.2 meters) in length. Together, the mechanically-set packers 304 and the intermediate swellable packer 308 surround the main body section 302. Alternatively, a short spacing may be provided between the mechanically-set packers 304 in lieu of the swellable packer 308.

The packer assembly 300 also includes a plurality of shunt tubes. The shunt tubes are seen in phantom at 318. The shunt tubes 318 may also be referred to as transport tubes or jumper tubes. The shunt tubes 318 are blank sections of pipe having a length that extends along the length 316 of the mechanically-set packers 304 and the swellable packer 308. The shunt tubes 318 on the packer assembly 300 are configured to couple to and form a seal with shunt tubes on connected sand screens as discussed further below.

The shunt tubes 318 provide an alternate flowpath through the mechanically-set packers 304 and the intermediate swellable packer 308 (or spacing). This enables the shunt tubes 318 to transport a carrier fluid along with gravel to different intervals 112, 114 and 116 of the open-hole portion 120 of the wellbore 100.

The packer assembly 300 also includes connection members. These may represent traditional threaded couplings. First, a neck section 306 is provided at a first end of the packer assembly 300. The neck section 306 has external threads for connecting with a threaded coupling box of a sand screen or other pipe. Then, a notched or externally threaded section 310 is provided at an opposing second end. The threaded section 310 serves as a coupling box for receiving an external threaded end of a sand screen or other tubular member.

The neck section 306 and the threaded section 310 may be made of steel or steel alloys. The neck section 306 and the threaded section 310 are each configured to be a specific length 314, such as 4 inches (10.2 cm) to 4 feet (1.2 meters) (or other suitable distance). The neck section 306 and the threaded section 310 also have specific inner and outer diameters. The neck section 306 has external threads 307, while the threaded section 310 has internal threads 311. These threads 307 and 311 may be utilized to form a seal between the packer assembly 300 and sand control devices or other pipe segments.

Figure 3C:
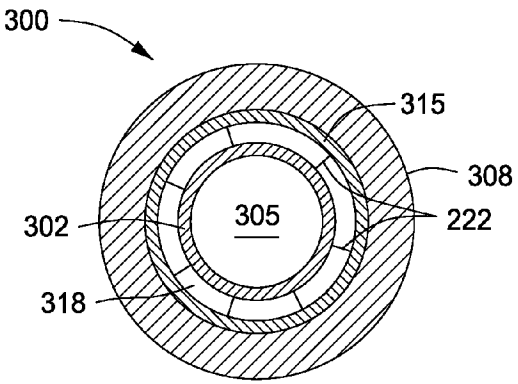
FIG. 3C is a cross-sectional view of the packer assembly of FIG. 3A, in an alternate embodiment. In lieu of shunt tubes, transport tubes are seen manifolded around the base pipe.
Figure 3B:
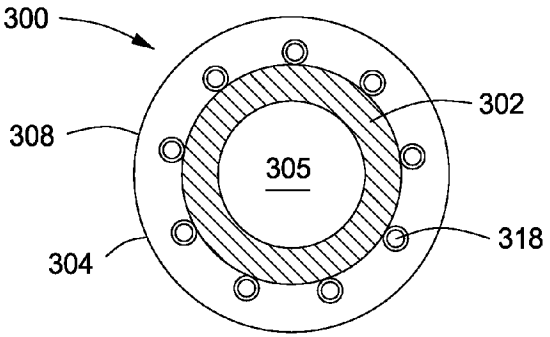
FIG. 3B is a cross-sectional view of the packer assembly of FIG. 3A, taken across lines 3B-3B of FIG. 3A. Shunt tubes are seen within the swellable packer element.

A cross-sectional view of the packer assembly 300 is shown in FIG. 3B. FIG. 3B is taken along the line 3B-3B of FIG. 3A. In FIG. 3B, the swellable packer 308 is seen circumferentially disposed around the base pipe 302. Various shunt tubes 318 are placed radially and equidistantly around the base pipe 302. A central bore 305 is shown within the base pipe 302. The central bore 305 receives production fluids during production operations and conveys them to the production tubing 130.

Figure 4A:
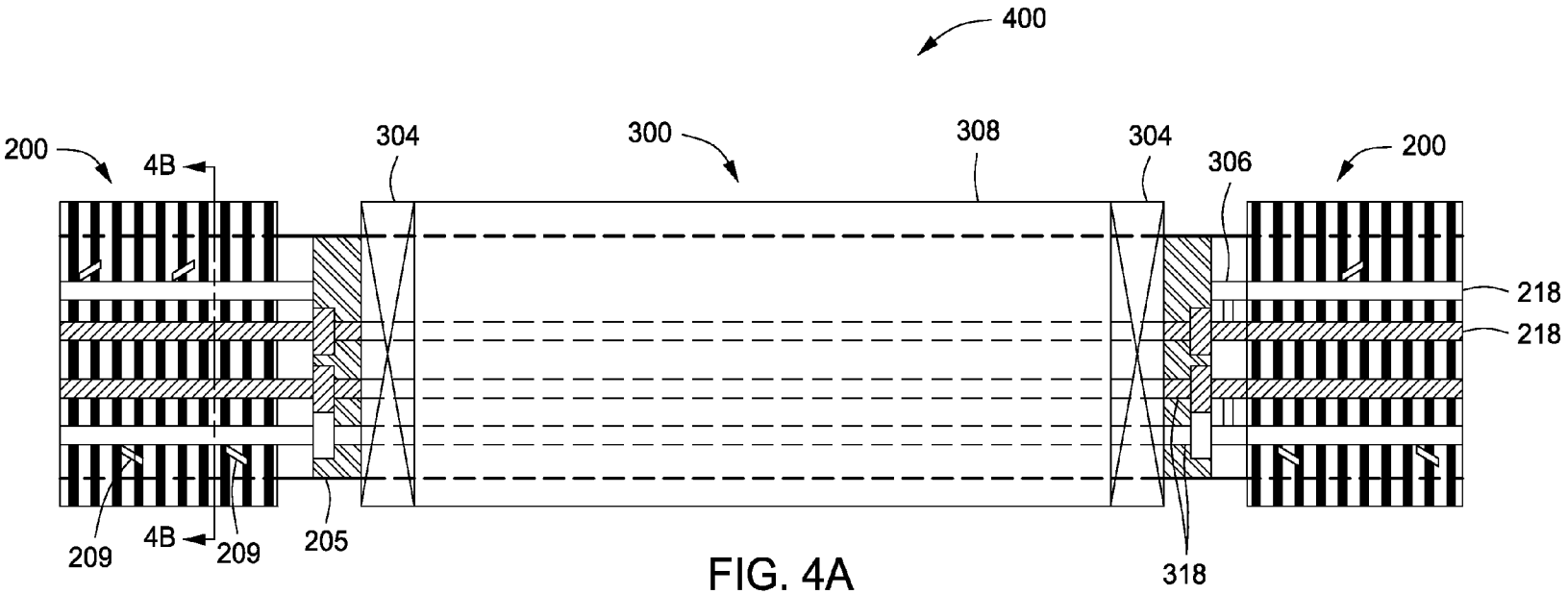
FIG. 4A is a cross-sectional side view of the packer assembly of FIG. 3A. Here, sand control devices, or sand screens, have been placed at opposing ends of the packer assembly. The sand control devices utilize external shunt tubes.

FIG. 4A presents a cross-sectional side view of a zonal isolation apparatus 400, in one embodiment. The zonal isolation apparatus 400 includes the packer assembly 300 from FIG. 3A. In addition, sand control devices 200 have been connected at opposing ends to the neck section 306 and the notched section 310, respectively. Shunt tubes 318 from the packer assembly 300 are seen connected to shunt tubes 218 on the sand control devices 200. The selective shunt tubes 218 on the sand control devices 200 include ports or nozzles or orifices 209, such shunt tubes called packing tubes, to allow flow of gravel slurry between a wellbore annulus and the packing tubes. The shunt tubes 218 on the sand control devices 200 may optionally include valves at 209 to control the flow of gravel slurry such as to packing tubes (not shown).

Figure 4B:
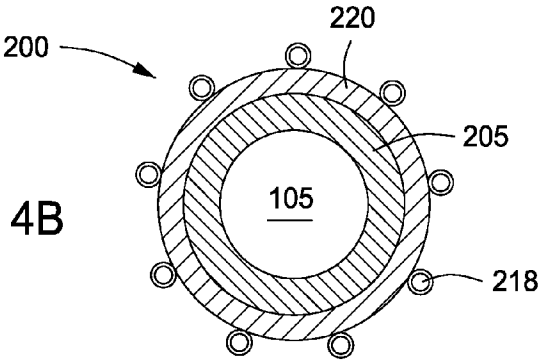
FIG. 4B provides a cross-sectional view of the packer assembly of FIG. 4A, taken across line 4B-4B of FIG. 4A. Shunt tubes are seen outside of the sand screen to provide an alternative flowpath for a particulate slurry.

FIG. 4B provides a cross-sectional side view of the zonal isolation apparatus 400. FIG. 4B is taken along the line 4B-4B of FIG. 4A. This is cut through one of the sand screens 200. In FIG. 4B, the slotted or perforated base pipe 205 is seen. This is in accordance with base pipe 205 of FIGS. 1 and 2. The central bore 105 is shown within the base pipe 205 for receiving production fluids during production operations.

An outer mesh 220 is disposed immediately around the base pipe 205. The outer mesh 220 preferably comprises a wire mesh or wires helically wrapped around the base pipe 205, and serves as a screen. In addition, shunt tubes 218 are placed radially and equidistantly around the outer mesh 205. This means that the sand control devices 200 provide an external embodiment for the shunt tubes 218 (or alternate flow channels).

The configuration of the shunt tubes 218 is preferably concentric. This is seen in the cross-sectional view of FIG. 3B. However, the shunt tubes 218 may be eccentrically designed. For example, FIG. 2B in U.S. Pat. No. 7,661,476 presents a "Prior Art" arrangement for a sand control device wherein packing tubes 208*a* and transport tubes 208*b* are placed external to the base pipe 202 and surrounding filter medium 204.

A concentric flow channel sand screen comprises a central bore that receives production fluids, and a filtering medium concentrically disposed around the central bore. Further, two or more shunt tubes are placed radially around the central bore. An eccentric flow channel screen also comprises a central bore that receives production fluids, but with a filtering medium disposed eccentrically around the central bore. Two or more shunt tubes are placed adjacent the central bore, typically outside of both the central bore and the filtering medium. An outer shroud may be placed around the shunt tubes representing packing tubes and transport tubes.

In the arrangement of FIGS. 4A and 4B, the shunt tubes 218 are external to the filter medium, or outer mesh 220. However, the configuration of the sand control device 200 may be modified. In this respect, the shunt tubes 218 may be moved internal to the filter medium 220.

Figure 5A:
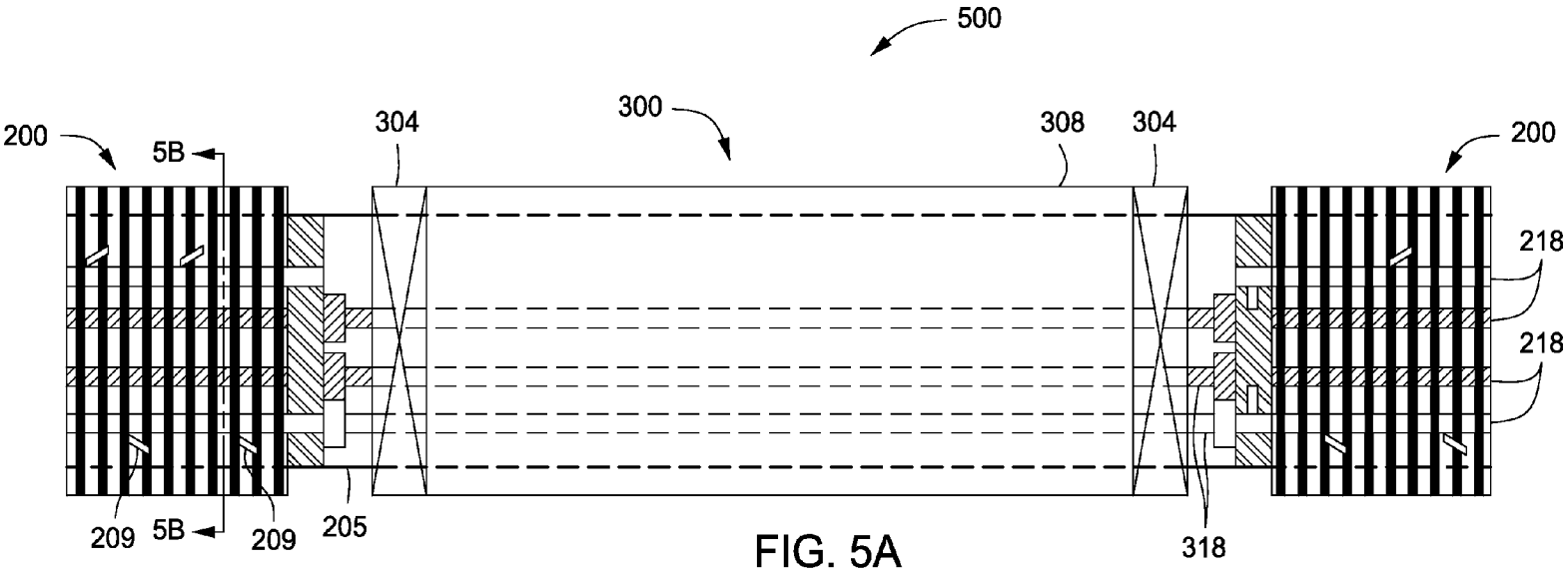
FIG. 5A is another cross-sectional side view of the packer assembly of FIG. 3A. Here, sand control devices, or sand screens, have again been placed at opposing ends of the packer assembly. However, the sand control devices utilize internal shunt tubes.

FIG. 5A presents a cross-sectional side view of a zonal isolation apparatus 500, in an alternate embodiment. In this embodiment, sand control devices 200 are again connected at opposing ends to the neck section 306 and the notched section 310, respectively, of the packer assembly 300. In addition, shunt tubes 318 on the packer assembly 300 are seen connected to shunt tubes 218 on the sand control assembly 200. However, in FIG. 5A, the sand control assembly 200 utilizes internal shunt tubes 218, meaning that the shunt tubes 218 are disposed between the base pipe 205 and the surrounding filter medium 220.

Figure 5B:
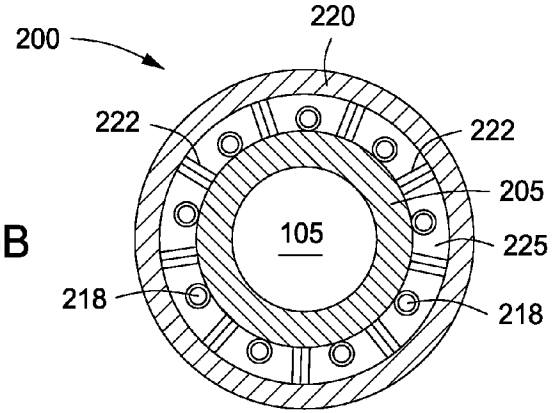
FIG. 5B provides a cross-sectional view of the packer assembly of FIG. 5A, taken across line 5B-5B of FIG. 5A. Shunt tubes are seen within the sand screen to provide an alternative flowpath for a particulate slurry.

FIG. 5B provides a cross-sectional side view of the zonal isolation apparatus 500. FIG. 5B is taken along the line B-B of FIG. 5A. This is cut through one of the sand screens 200. In FIG. 5B, the slotted or perforated base pipe 205 is again seen. This is in accordance with base pipe 205 of FIGS. 1 and 2. The central bore 105 is shown within the base pipe 205 for receiving production fluids during production operations.

Shunt tubes 218 are placed radially and equidistantly around the base pipe 205. The shunt tubes 218 reside immediately around the base pipe 205, and within a surrounding filter medium 220. This means that the sand control devices 200 of FIGS. 5A and 5B provide an internal embodiment for the shunt tubes 218.

An annular region 225 is created between the base pipe 205 and the surrounding outer mesh or filter medium 220. The annular region 225 accommodates the inflow of production fluids in a wellbore. The outer wire wrap 220 is supported by a plurality of radially extending support ribs 222. The ribs 222 extend through the annular region 225.

FIGS. 4A and 5A present arrangements for connecting sand control joints to a packer assembly. Shunt tubes 318 (or alternate flow channels) within the packers fluidly connect to shunt tubes 218 along the sand screens 200. However, the zonal isolation apparatus arrangements 400, 500 of FIGS. 4A-4B and 5A-5B are merely illustrative. In an alternative arrangement, a manifolding system may be used for providing fluid communication between the shunt tubes 218 and the shunt tubes 318.

FIG. 3C is a cross-sectional view of the packer assembly 300 of FIG. 3A, in an alternate embodiment. In this arrangement, the shunt tubes 218 are manifolded around the base pipe 302. A support ring 315 is provided around the shunt tubes 318. Walls 222 separate the shunt tubes 318 within the swellable packer element 308. It is again understood that the present apparatus and methods are not confined by the particular design and arrangement of shunt tubes 318 so long as slurry bypass is provided for the packer assembly 210. However, it is preferred that a concentric arrangement be employed.

It should also be noted that the coupling mechanism for the sand control devices 200 with the packer assembly 300 may include a sealing mechanism (not shown). The sealing mechanism prevents leaking of the slurry that is in the alternate flowpath formed by the shunt tubes. Examples of such sealing mechanisms are described in U.S. Pat. No. 6,464,261; Intl. Pat. Application Publ. No. WO 2004/094769; Intl. Pat. Application Publ. No. WO 2005/031105; U.S. Pat. Publ. No. 2004/0140089; U.S. Pat. Publ. No. 2005/0028977; U.S. Pat. Publ. No. 2005/0061501; and U.S. Pat. Publ. No. 2005/0082060.

As noted, the packer assembly 300 includes a pair of mechanically-set packers 304. When using the packer assembly 300, the packers 304 are beneficially set before the slurry is injected and the gravel pack is formed. This requires a unique packer arrangement wherein shunt tubes are provided for an alternate flow channel.

Figure 6A:
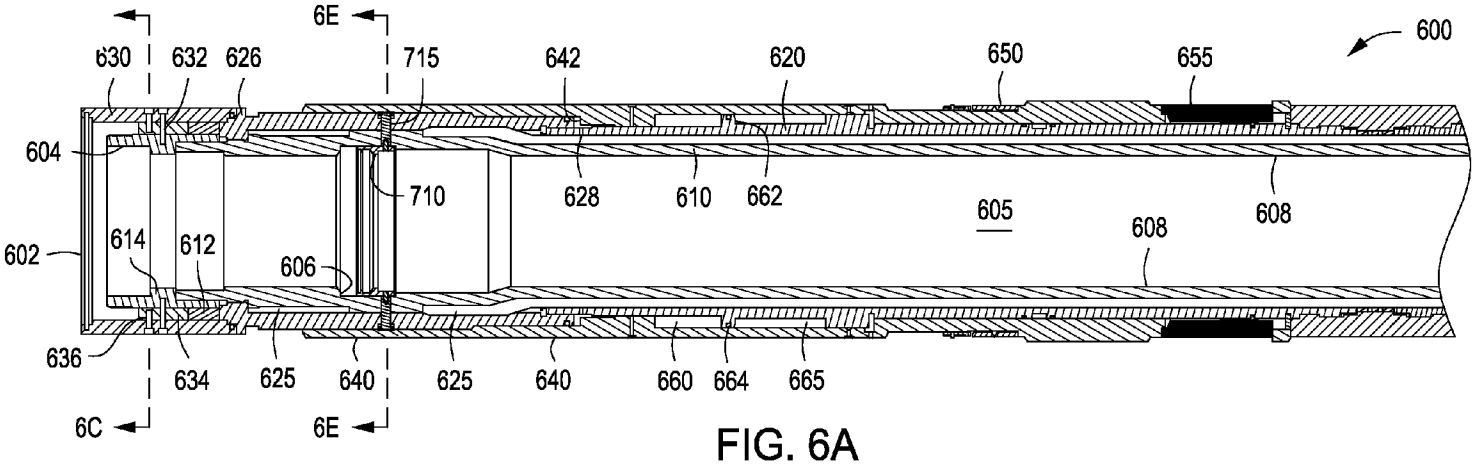
FIG. 6A is a cross-sectional side view of one of the mechanically-set packers of FIG. 3A. The mechanically-set packer is in its run-in position.
Figure 6B:
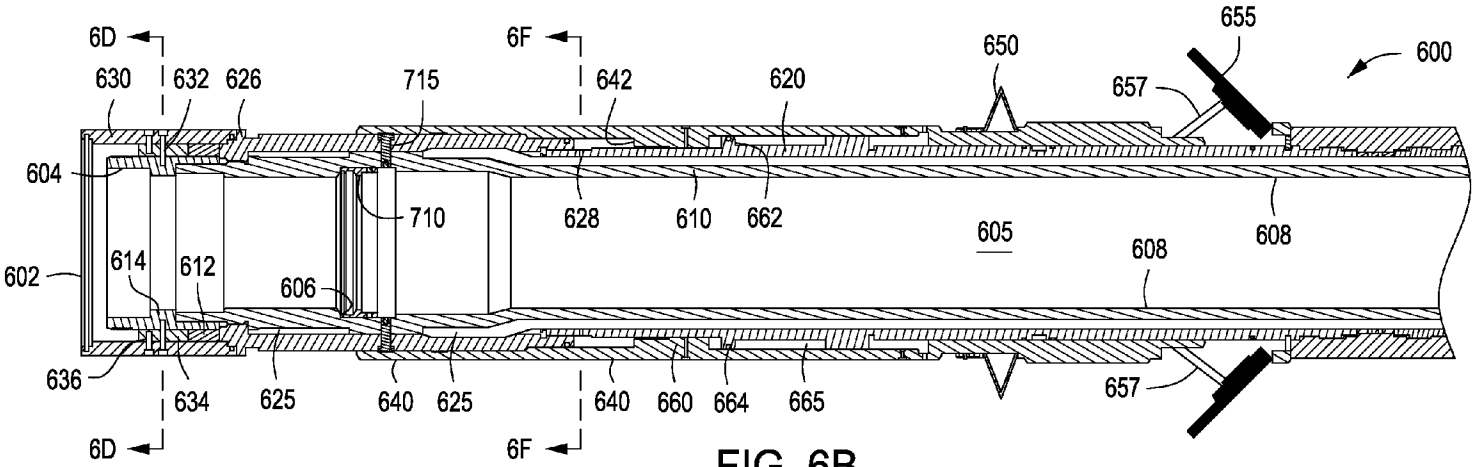
FIG. 6B is a cross-sectional side view of the mechanically-set packer of FIG. 6A. Here, the mechanically-set packer element is in its set position.

The packers 304 of FIG. 3A are shown schematically. However, FIGS. 6A and 6B provide more detailed views of a mechanically-set packer 600 that may be used in the packer assembly of FIG. 3A, in one embodiment. The views of FIGS. 6A and 6B provide cross-sectional side views. In FIG. 6A, the packer 600 is in its run-in position, while in FIG. 6B the packer 600 is in its set position.

Other embodiments of sand control devices 200 may be used with the apparatuses and methods herein. For example, the sand control devices may include stand-alone screens (SAS), pre-packed screens, or membrane screens. The joints may be any combination of screen, blank pipe, or zonal isolation apparatus.

The packer 600 first includes an inner mandrel 610. The inner mandrel 610 defines an elongated tubular body forming a central bore 605. The central bore 605 provides a primary flow path of production fluids through the packer 600. After installation and commencement of production, the central bore 605 transports production fluids to the bore 105 of the sand screens 200 (seen in FIGS. 4A and 4B) and the production tubing 130 (seen in FIGS. 1 and 2).

The packer 600 also includes a first end 602. Threads 604 are placed along the inner mandrel 610 at the first end 602. The illustrative threads 604 are external threads. A box connector 614 having internal threads at both ends is connected or threaded on threads 604 at the first end 602. The first end 602 of inner mandrel 610 with the box connector 614 is called the box end. The second end (not shown) of the inner mandrel 610 has external threads and is called the pin end. The pin end (not shown) of the inner mandrel 610 allows the packer 600 to be connected to the box end of a sand screen or other tubular body such as a stand-alone screen, a sensing module, a production tubing, or a blank pipe.

The box connector 614 at the box end 602 allows the packer 600 to be connected to the pin end of a sand screen or other tubular body such as a stand-alone screen, a sensing module, a production tubing, or a blank pipe.

The inner mandrel 610 extends along the length of the packer 600. The inner mandrel 610 may be composed of multiple connected segments, or joints. The inner mandrel 610 has a slightly smaller inner diameter near the first end 602. This is due to a setting shoulder 606 machined into the inner mandrel. As will be explained more fully below, the setting shoulder 606 catches a release sleeve 710 in response to mechanical force applied by a setting tool.

The packer 600 also includes a piston mandrel 620. The piston mandrel 620 extends generally from the first end 602 of the packer 600. The piston mandrel 620 may be composed of multiple connected segments, or joints. The piston mandrel 620 defines an elongated tubular body that resides circumferentially around and substantially concentric to the inner mandrel 610. An annulus 625 is formed between the inner mandrel 610 and the surrounding piston mandrel 620. The annulus 625 beneficially provides a secondary flow path or alternate flow channels for fluids.

In the arrangement of FIGS. 6A and 6B, the alternate flow channels defined by the annulus 625 are external to the inner mandrel 610. However, the packer could be reconfigured such that the alternate flow channels are within the bore 605 of the inner mandrel 610. In either instance, the alternate flow channels are "along" the inner mandrel 610.

The annulus 625 is in fluid communication with the secondary flow path of another downhole tool (not shown in FIGS. 6A and 6B). Such a separate tool may be, for example, the sand screens 200 of FIGS. 4A and 5A, or a blank pipe, a swellable zonal isolation packer such as packer 308 of FIG. 3A, or other tubular body. The tubular body may or may not have alternate flow channels.

The packer 600 also includes a coupling 630. The coupling 630 is connected and sealed (e.g., via elastomeric "o" rings) to the piston mandrel 620 at the first end 602. The coupling 630 is then threaded and pinned to the box connector 614, which is threadedly connected to the inner mandrel 610 to prevent relative rotational movement between the inner mandrel 610 and the coupling 630. A first torque bolt is shown at 632 for pinning the coupling to the box connector 614.

In one aspect, a NACA (National Advisory Committee for Aeronautics) key 634 is also employed. The NACA key 634 is placed internal to the coupling 630, and external to a threaded box connector 614. A first torque bolt is provided at 632, connecting the coupling 630 to the NACA key 634 and then to the box connector 614. A second torque bolt is provided at 636 connecting the coupling 630 to the NACA key 634. NACA-shaped keys can (a) fasten the coupling 630 to the inner mandrel 610 via box connector 614, (b) prevent the coupling 630 from rotating around the inner mandrel 610, and (c) streamline the flow of slurry along the annulus 612 to reduce friction.

Within the packer 600, the annulus 625 around the inner mandrel 610 is isolated from the main bore 605. In addition, the annulus 625 is isolated from a surrounding wellbore annulus (not shown). The annulus 625 enables the transfer of gravel slurry from alternative flow channels (such as shunt tubes 218) through the packer 600. Thus, the annulus 625 becomes the alternative flow channel(s) for the packer 600.

In operation, an annular space 612 resides at the first end 602 of the packer 600. The annular space 612 is disposed between the box connector 614 and the coupling 630. The annular space 612 receives slurry from alternate flow channels of a connected tubular body, and delivers the slurry to the annulus 625. The tubular body may be, for example, an adjacent sand screen, a blank pipe, or a zonal isolation device.

The packer 600 also includes a load shoulder 626. The load shoulder 626 is placed near the end of the piston mandrel 620 where the coupling 630 is connected and sealed. A solid section at the end of the piston mandrel 620 has an inner diameter and an outer diameter. The load shoulder 626 is placed along the outer diameter. The inner diameter has threads and is threadedly connected to the inner mandrel 610. At least one alternate flow channel is formed between the inner and outer diameters to connect flow between the annular space 612 and the annulus 625.

The load shoulder 626 provides a load-bearing point. During rig operations, a load collar or harness (not shown) is placed around the load shoulder 626 to allow the packer 600 to be picked up and supported with conventional elevators. The load shoulder 626 is then temporarily used to support the weight of the packer 600 (and any connected completion devices such as sand screen joints already run into the well) when placed in the rotary floor of a rig. The load may then be transferred from the load shoulder 626 to a pipe thread connector such as box connector 614, then to the inner mandrel 610 or base pipe 205, which is pipe threaded to the box connector 614.

The packer 600 also includes a piston housing 640. The piston housing 640 resides around and is substantially concentric to the piston mandrel 620. The packer 600 is configured to cause the piston housing 640 to move axially along and relative to the piston mandrel 620. Specifically, the piston housing 640 is driven by the downhole hydrostatic pressure. The piston housing 640 may be composed of multiple connected segments, or joints.

The piston housing 640 is held in place along the piston mandrel 620 during run-in. The piston housing 640 is secured using a release sleeve 710 and release key 715. The release sleeve 710 and release key 715 prevent relative translational movement between the piston housing 640 and the piston mandrel 620. The release key 715 penetrates through both the piston mandrel 620 and the inner mandrel 610.

Figure 7A:
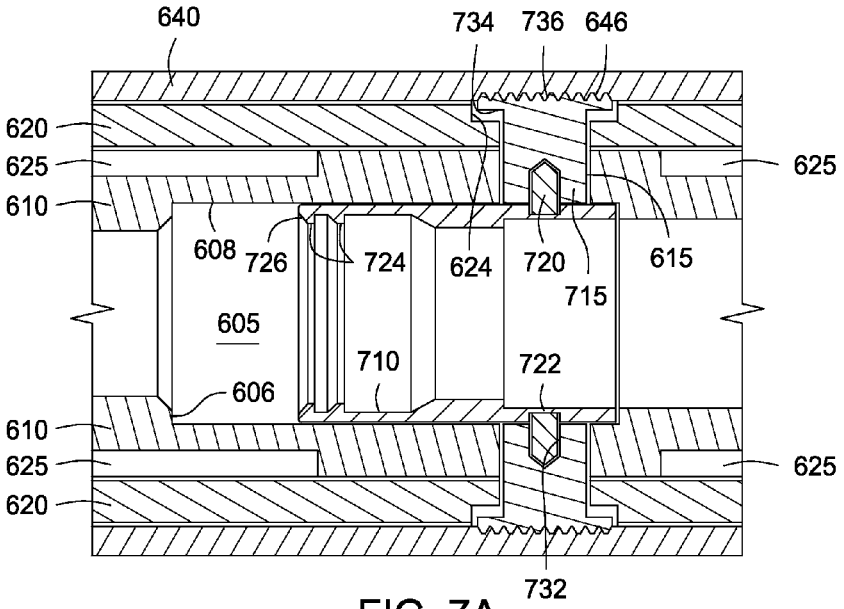
FIG. 7A is an enlarged view of the release key of FIG. 6A. The release key is in its run-in position along the inner mandrel. The shear pin has not yet been sheared.
Figure 7B:
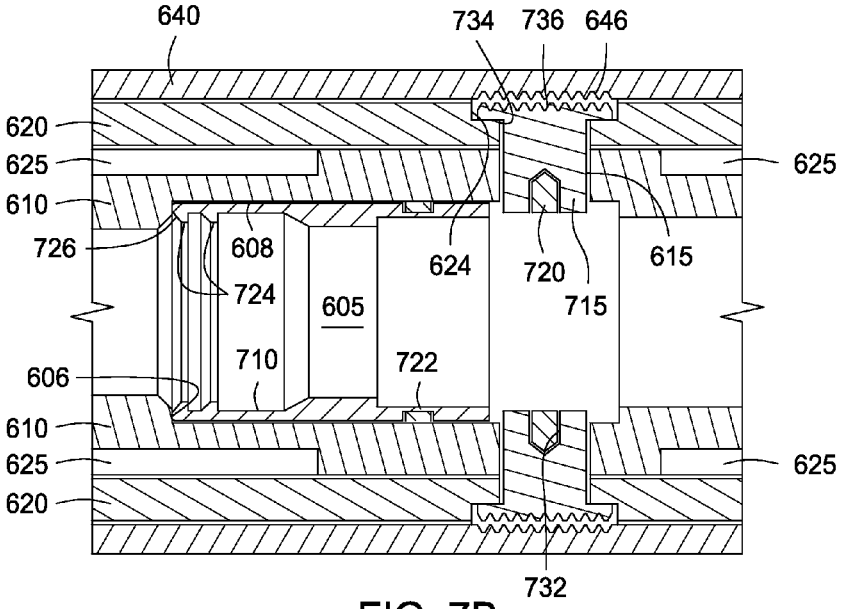
FIG. 7B is an enlarged view of the release key of FIG. 6B. The shear pin has been sheared, and the release key has dropped away from the inner mandrel.

FIGS. 7A and 7B provide enlarged views of the release sleeve 710 and the release key 715 for the packer 600. The release sleeve 710 and the release key 715 are held in place by a shear pin 720. In FIG. 7A, the shear pin 720 has not been sheared, and the release sleeve 710 and the release key 715 are held in place along the inner mandrel 610. However, in FIG. 7B the shear pin 720 has been sheared, and the release sleeve 710 has been translated along an inner surface 608 of the inner mandrel 610.

In each of FIGS. 7A and 7B, the inner mandrel 610 and the surrounding piston mandrel 620 are seen. In addition, the piston housing 640 is seen outside of the piston mandrel 620. The three tubular bodies representing the inner mandrel 610, the piston mandrel 620, and the piston housing 640 are secured together against relative translational or rotational movement by four release keys 715. Only one of the release keys 715 is seen in FIG. 7A; however, four separate keys 715 are radially visible in the cross-sectional view of FIG. 6E, described below.

The release key 715 resides within a keyhole 615. The keyhole 615 extends through the inner mandrel 610 and the piston mandrel 620. The release key 715 includes a shoulder 734. The shoulder 734 resides within a shoulder recess 624 in the piston mandrel 620. The shoulder recess 624 is large enough to permit the shoulder 734 to move radially inwardly. However, such play is restricted in FIG. 7A by the presence of the release sleeve 710.

It is noted that the annulus 625 between the inner mandrel 610 and the piston mandrel 620 is not seen in FIG. 7A or 7B. This is because the annulus 625 does not extend through this cross-section, or is very small. Instead, the annulus 625 employs separate radially-spaced channels that preserve the support for the release keys 715, as seen best in FIG. 6E. Stated another way, the large channels making up the annulus 625 are located away from the material of the inner mandrel 610 that surrounds the keyholes 615.

At each release key location, a keyhole 615 is machined through the inner mandrel 610. The keyholes 615 are drilled to accommodate the respective release keys 715. If there are four release keys 715, there will be four discrete bumps spaced circumferentially to significantly reduce the annulus 625. The remaining area of the annulus 625 between adjacent bumps allows flow in the alternate flow channel 625 to by-pass the release key 715.

Bumps may be machined as part of the body of the inner mandrel 610. More specifically, material making up the inner mandrel 610 may be machined to form the bumps. Alternatively, bumps may be machined as a separate, short release mandrel (not shown), which is then threaded to the inner mandrel 610. Alternatively still, the bumps may be a separate spacer secured between the inner mandrel 610 and the piston mandrel 620 by welding or other means.

It is also noted here that in FIG. 6A, the piston mandrel 620 is shown as an integral body. However, the portion of the piston mandrel 620 where the keyholes 615 are located may be a separate, short release housing. This separate housing is then connected to the main piston mandrel 620.

Each release key 715 has an opening 732. Similarly, the release sleeve 710 has an opening 722. The opening 732 in the release key 715 and the opening 722 in the release sleeve 710 are sized and configured to receive a shear pin. The shear pin is seen at 720. In FIG. 7A, the shear pin 720 is held within the openings 732, 722 by the release sleeve 710. However, in FIG. 7B the shear pin 720 has been sheared, and only a small portion of the pin 720 remains visible.

An outer edge of the release key 715 has a ruggled surface, or teeth. The teeth for the release key 715 are shown at 736. The teeth 736 of the release key 715 are angled and configured to mate with a reciprocal ruggled surface within the piston housing 640. The mating ruggled surface (or teeth) for the piston housing 640 are shown at 646. The teeth 646 reside on an inner face of the piston housing 640. When engaged, the teeth 736, 646 prevent movement of the piston housing 640 relative to the piston mandrel 620 or the inner mandrel 610. Preferably, the mating ruggled surface or teeth 646 reside on the inner face of a separate, short outer release sleeve, which is then threaded to the piston housing 640.

Returning now to FIGS. 6A and 6B, the packer 600 includes a centralizing member 650. The centralizing member 650 is actuated by the movement of the piston housing 640. The centralizing member 650 may be, for example, as described in WO/2009/071874, entitled "Improved Centraliser." This application was filed on behalf of Petrowell Ltd., and has an international filing date of Nov. 28, 2008. The international application is incorporated herein in its entirety.

The packer 600 further includes a sealing element 655. As the centralizing member 650 is actuated and centralizes the packer 600 within the surrounding wellbore, the piston housing 640 continues to actuate the sealing element 655 as described in WO/2007/107773, entitled "Improved Packer" having an international filing date of Mar. 22, 2007. The international application is incorporated herein in its entirety by reference.

In FIG. 6A, the centralizing member 650 and sealing element 655 are in their run-in position. In FIG. 6B, the centralizing member 650 and connected sealing element 655 have been actuated. This means the piston housing 640 has moved along the piston mandrel 620, causing both the centralizing member 650 and the sealing element 655 to engage the surrounding wellbore wall.

An anchor system as described in WO 2010/084353 may be used to prevent the piston housing 640 from going backward. This prevents contraction of the cup-type element 655.

As noted, movement of the piston housing 640 takes place in response to hydrostatic pressure from wellbore fluids, including the gravel slurry. In the run-in position of the packer 600 (shown in FIG. 6A), the piston housing 640 is held in place by the release sleeve 710 and associated piston key 715. This position is shown in FIG. 7A. In order to set the packer 600 (in accordance with FIG. 6B), the release sleeve 710 must be moved out of the way of the release key 715 so that the teeth 736 of the release key 715 are no longer engaged with the teeth 646 of the piston housing 640. This position is shown in FIG. 7B.

To move the release the release sleeve 710, a setting tool is used. An illustrative setting tool is shown at 750 in FIG. 7C. The setting tool 750 defines a short cylindrical body 755. Preferably, the setting tool 750 is run into the wellbore with a washpipe string (not shown). Movement of the washpipe string along the wellbore can be controlled at the surface.

An upper end 752 of the setting tool 750 is made up of several radial collet fingers 760. The collet fingers 760 collapse when subjected to sufficient inward force. In operation, the collet fingers 760 latch into a profile 724 formed along the release sleeve 710. The collet fingers 760 include raised surfaces 762 that mate with or latch into the profile 724 of the release key 710. Upon latching, the setting tool 750 is pulled or raised within the wellbore. The setting tool 750 then pulls the release sleeve 710 with sufficient force to cause the shear pins 720 to shear. Once the shear pins 720 are sheared, the release sleeve 710 is free to translate upward along the inner surface 608 of the inner mandrel 610.

Figure 7C:
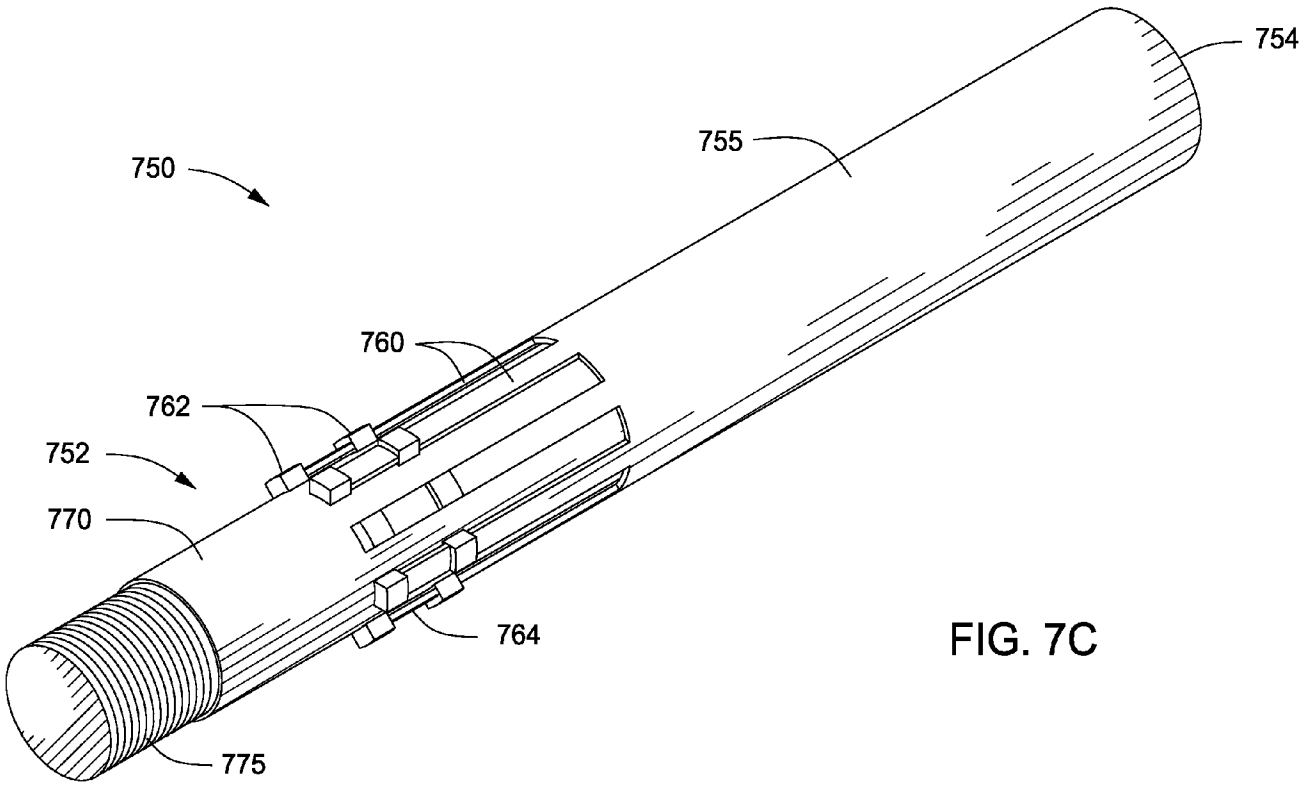
FIG. 7C is a perspective view of a setting tool as may be used to latch onto a release sleeve, and thereby shear a shear pin within the release key.

As noted, the setting tool 750 may be run into the wellbore with a washpipe. The setting tool 750 may simply be a profiled portion of the washpipe body. Preferably, however, the setting tool 750 is a separate tubular body 755 that is threadedly connected to the washpipe. In FIG. 7C, a connection tool is provided at 770. The connection tool 770 includes external threads 775 for connecting to a drill string or other run-in tubular. The connection tool 770 extends into the body 755 of the setting tool 750. The connection tool 770 may extend all the way through the body 755 to connect to the washpipe or other device, or it may connect to internal threads (not seen) within the body 755 of the setting tool 750.

Returning to FIGS. 7A and 7B, the travel of the release sleeve 710 is limited. In this respect, a first or top end 726 of the release sleeve 710 stops against the shoulder 606 along the inner surface 608 of the inner mandrel 610. The length of the release sleeve 710 is short enough to allow the release sleeve 710 to clear the opening 732 in the release key 715. When fully shifted, the release key 715 moves radially inward, pushed by the ruggled profile in the piston housing 640 when hydrostatic pressure is present.

Shearing of the pin 720 and movement of the release sleeve 710 also allows the release key 715 to disengage from the piston housing 640. The shoulder recess 624 is dimensioned to allow the shoulder 734 of the release key 715 to drop or to disengage from the teeth 646 of the piston housing 640 once the release sleeve 710 is cleared. Hydrostatic pressure then acts upon the piston housing 640 to translate it downward relative to the piston mandrel 620.

After the shear pins 720 have been sheared, the piston housing 640 is free to slide along an outer surface of the piston mandrel 620. To accomplish this, hydrostatic pressure from the annulus 625 acts upon a shoulder 642 in the piston housing 640. This is seen best in FIG. 6B. The shoulder 642 serves as a pressure-bearing surface. A fluid port 628 is provided through the piston mandrel 620 to allow fluid to access the shoulder 642. Beneficially, the fluid port 628 allows a pressure higher than hydrostatic pressure to be applied during gravel packing operations. The pressure is applied to the piston housing 640 to ensure that the packer elements 655 engage against the surrounding wellbore.

The packer 600 also includes a metering device. As the piston housing 640 translates along the piston mandrel 620, a metering orifice 664 regulates the rate the piston housing translates along the piston mandrel therefore slowing the movement of the piston housing and regulating the setting speed for the packer 600.

To further understand features of the illustrative mechanically-set packer 600, several additional cross-sectional views are provided. These are seen at FIGS. 6C, 6D, 6E, and 6F.

Figure 6D:
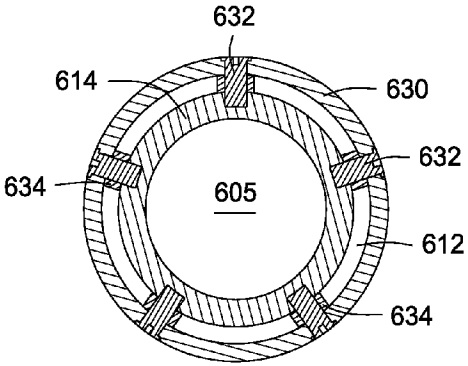
FIG. 6D is a cross-sectional view of the packer of FIG. 6A. The view is taken across line 6D-6D of FIG. 6B.
Figure 6C:
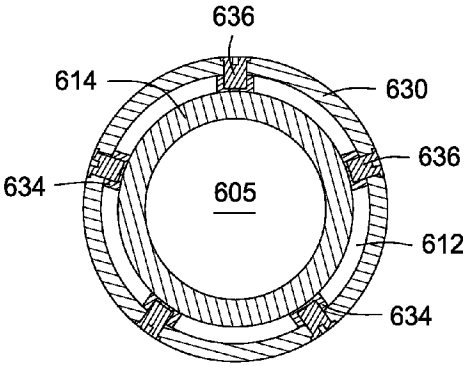
FIG. 6C is a cross-sectional view of the mechanically-set packer of FIG. 6A. The view is taken across line 6C-6C of FIG. 6A.

First, FIG. 6C is a cross-sectional view of the mechanically-set packer of FIG. 6A. The view is taken across line 6C-6C of FIG. 6A. Line 6C-6C is taken through one of the torque bolts 636. The torque bolt 636 connects the coupling 630 to the NACA key 634.

FIG. 6D is a cross-sectional view of the mechanically-set packer of FIG. 6A. The view is taken across line 6D-6D of FIG. 6B. Line 6D-6D is taken through another of the torque bolts 632. The torque bolt 632 connects the coupling 630 to the box connector 614, which is threaded to the inner mandrel 610.

Figure 6F:
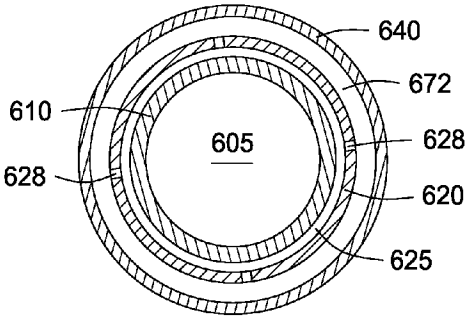
FIG. 6F is a cross-sectional view of the mechanically-set packer of FIG. 6A. The view is taken across line 6F-6F of FIG. 6B.
Figure 6E:
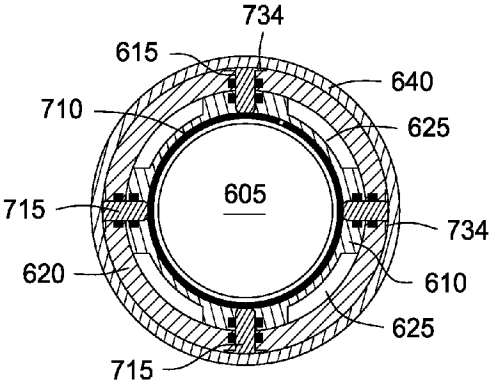
FIG. 6E is a cross-sectional view of the packer of FIG. 6A. The view is taken across line 6E-6E of FIG. 6A.

FIG. 6E is a cross-sectional view of the mechanically-set packer 600 of FIG. 6A. The view is taken across line 6E-6E of FIG. 6A. Line 6E-E is taken through the release key 715. It can be seen that the release key 715 passes through the piston mandrel 620 and into the inner mandrel 610. It is also seen that the alternate flow channel 625 resides between the release keys 715.

FIG. 6F is a cross-sectional view of the mechanically-set packer 600 of FIG. 6A. The view is taken across line 6F-6F of FIG. 6B. Line 6F-6F is taken through the fluid ports 628 within the piston mandrel 620. As the fluid moves through the fluid ports 628 and pushes the shoulder 642 of the piston housing 640 away from the ports 628, an annular gap 672 is created and elongated between the piston mandrel 620 and the piston housing 640.

Coupling sand control devices 200 with a packer assembly 300 requires alignment of the shunt tubes 318 in the packer assembly 300 with the shunt tubes 218 along the sand control devices 200. In this respect, the flow path of the shunt tubes 218 in the sand control devices should be un-interrupted when engaging a packer. FIG. 4A (described above) shows sand control devices 200 connected to an intermediate packer assembly 300, with the shunt tubes 218, 318 in alignment. However, making this connection typically requires a special sub or jumper with a union-type connection, a timed connection to align the multiple tubes, or a cylindrical cover plate over the connecting tubes. These connections are expensive, time-consuming, and/or difficult to handle on the rig floor.

U.S. Pat. No. 7,661,476, entitled "Gravel Packing Methods," discloses a production string (referred to as a joint assembly) that employs one or more sand screen joints. The sand screen joints are placed between a "load sleeve assembly" and a "torque sleeve assembly." The load sleeve assembly defines an elongated body comprising an outer wall (serving as an outer diameter) and an inner wall (providing an inner diameter). The inner wall forms a bore through the load sleeve assembly. Similarly, the torque sleeve assembly defines an elongated body comprising an outer wall (serving as an outer diameter) and an inner wall (providing an inner diameter). The inner wall also forms a bore through the torque sleeve assembly.

The load sleeve assembly includes at least one transport conduit and at least one packing conduit. The at least one transport conduit and the at least one packing conduit are disposed exterior to the inner diameter and interior to the outer diameter. Similarly, torque sleeve assembly includes at least one conduit. The at least one conduit is also disposed exterior to the inner diameter and interior to the outer diameter.

The load sleeve assembly and the torque sleeve assembly may be used for connecting a production string to a joint of a sand screen. The production string includes a "main body portion" that is placed in fluid communication with the base pipe of the sand screen through the load sleeve assembly and the torque sleeve assembly. The load sleeve assembly and the torque sleeve assembly are made up or coupled with the base pipe in such a manner that the transport and packing conduits are in fluid communication, thereby providing alternate flow channels for gravel slurry.

A coupling assembly may also be used for connecting the load sleeve assembly to a joint of sand screen. The coupling assembly has a manifold region, wherein the manifold region is configured to be in fluid flow communication with the at least one transport conduit and at least one packing conduit of the load sleeve assembly during at least a portion of gravel packing operations. Benefits of the load sleeve assembly, the torque sleeve assembly, and a coupling assembly is that they enable a series of sand screen joints to be connected and run into the wellbore in a faster and less expensive way.

The load sleeve and the torque sleeve of U.S. Pat. No. 7,661,476 assume that the sand screen and the packer being joined have a matching radial center. This means that the wellbore tools being run into the wellbore each have concentric flow paths, or they each have eccentric flow paths, and the flow paths match. However, it is desirable to be able to fluidly connect wellbore tools having different radial center lines. Further, it is desirable to be able to fluidly connect a first wellbore tool having a primary flow path that is concentric relative to that first tool, with a second wellbore tool having a primary flow path that is eccentric relative to that second tool. Accordingly, a crossover joint is provided herein.

Figure 8A:
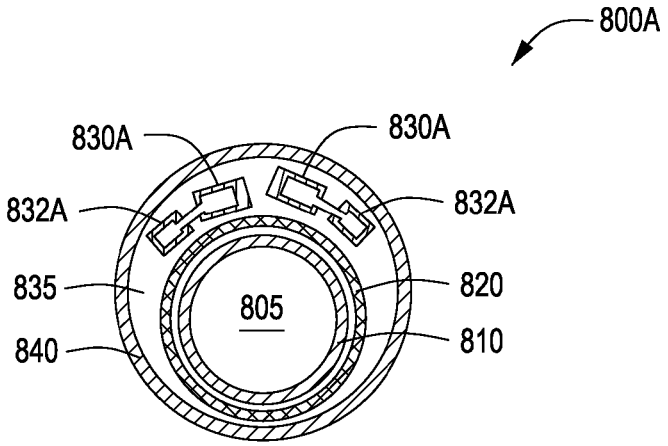
FIGS. 8A through 8C demonstrate various eccentric designs for a wellbore tool. Here, the wellbore tools are sand screens or blank pipes. Each of the illustrative sand screens or blank pipes comprises a base pipe, with one or more eccentric alternate flow channels there around providing secondary flow paths.
Figure 8B:
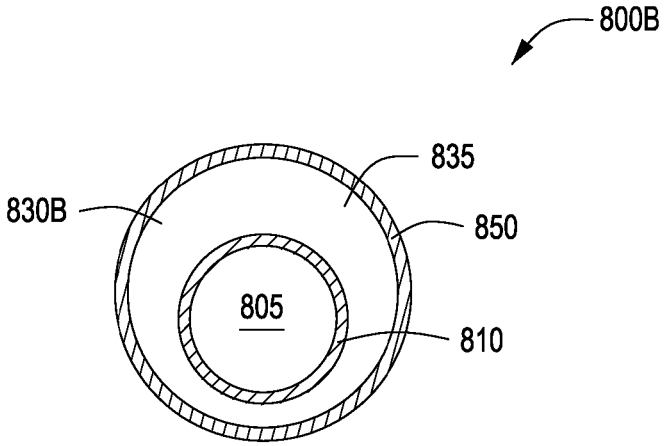
Figure 8C:
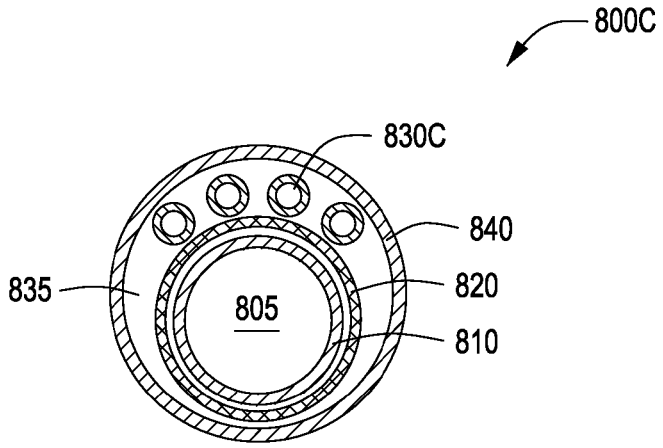

FIGS. 8A through 8C demonstrate various eccentric designs for a wellbore tool. Here, the illustrative wellbore tools are sand control devices. The sand control devices may be sand screens or blank pipes. Each of the wellbore tools 800A, 800B, 800C comprises a base pipe 810 that defines a bore 805 therein. The bore 805 represents a primary flow path. In addition, each of the wellbore tools 800A and 800C comprises a filter medium 820 around the base pipe 810. Finally, each of the wellbore tools 800A, 800B, 800C includes an alternate flow channel for a gravel slurry. The alternate flow channels in the illustrative sand screens 800A, 800C are rectangular or round shunt tubes; the alternate flow channel in the illustrative blank pipe 800B is an eccentric annulus between base pipe 810 and an outer housing 850.

In FIG. 8A, a first sand control device 800A is shown. The sand control device 800A includes the base pipe 810. The filter medium 820 is concentrically disposed around the base pipe 810. An outer protective shroud 840 is then eccentrically placed around the base pipe 810 and filter medium 820. The shroud 840 is perforated, meaning it permits the ingress of gravel slurry and wellbore fluids.

An annular area 835 is formed between the filter medium 820 and the surrounding shroud 840. Within the annular area 835 is a plurality of alternate flow channels. In the arrangement of FIG. 8A, these represent transport tubes 830A and packing tubes 832A. The use of transport tubes and packing tubes as alternate flow channels for gravel slurry in general is known in the art. The transport tubes 830A and packing tubes 832A reside around the filter medium 820.

In FIG. 8B, a blank pipe 800B is shown. The blank pipe 800B again includes the base pipe 810. In this arrangement, an outer housing 850 is eccentrically disposed around the base pipe 810. An eccentric an annular area 835 is formed between the base pipe 810 and surrounding housing 850 serves as the alternate flow channel 830B. The shunted blank pipe 800B is installed above the top joint of a screen or across an isolated section between packers, as is known in the art.

In FIG. 8C, a second sand control device 800C is shown. The sand control device 800C again includes the base pipe 810. In this arrangement, the filter medium 820 is concentrically disposed around the base pipe 810. An outer protective shroud 840 is then eccentrically placed around the base pipe 810 and filter medium 820. The shroud 840 is perforated, meaning it permits the ingress of gravel slurry and wellbore fluids. An annular area 835 is again formed between the filter medium 820 and surrounding shroud 840.

In FIG. 8C, shunt tubes 830C are provided in the annular area 835. The shunt tubes 830C serve as the alternate flow channels.

In each of FIGS. 8A, 8B and 8C, the respective alternate flow channels 830A, 830B, 830C represent secondary flow paths. These secondary flow paths are eccentric to a radial center of the wellbore tools 800A, 800B, 800C. In one embodiment, an eccentric screen arrangement offers lower friction in the secondary flow paths when compared to shunt tubes in a concentric screen. It is believed that the use of eccentric screens at the toe of a horizontal completion will reduce the overall friction or extend the maximum gravel packing length of the completion.

Figure 9A:
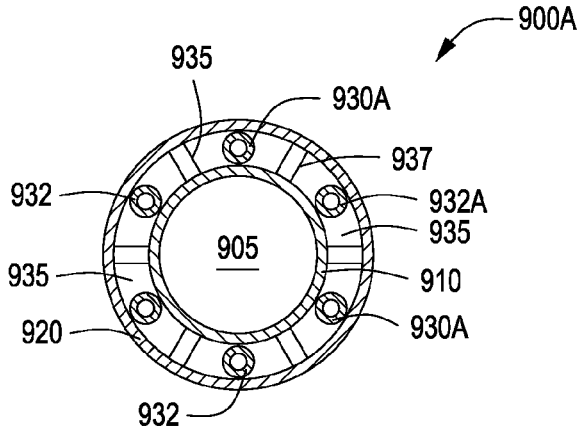
FIGS. 9A through 9C demonstrate various concentric designs for a wellbore tool. Here, the wellbore tools are packers. Each of the illustrative packers comprises a base pipe, with concentric alternate flow channels there around providing secondary flow paths.
Figure 9B:
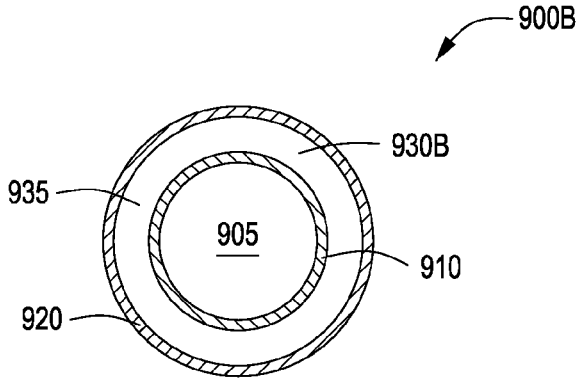
Figure 9C:
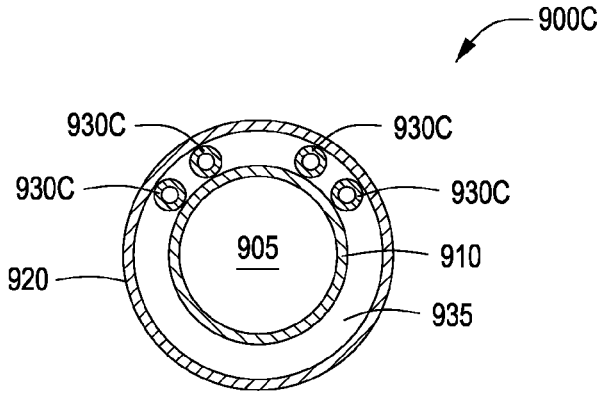

FIGS. 9A through 9C demonstrate various concentric designs for a wellbore tool. Here, the illustrative wellbore tools are packers. Each of the packers 900A, 900B, 900C comprises a base pipe 910 that defines a bore 905 therein. The bore 905 represents a primary flow path. In addition, each of the packers 900A, 900B, 900C comprises an outer housing 920 around the base pipe 910.

In FIG. 9A, a first packer 900A is shown. The packer 900A includes the base pipe 910. The housing 920 is concentrically disposed around the base pipe 910. An annular area 935 is formed between the base pipe 910 and the surrounding housing 920. The annular area 935 optionally contains ribs 937 for supporting and spacing the housing 920 around the base pipe 910.

The annular area 935 also contains a plurality of alternate flow channels. In the arrangement of FIG. 9A, these represent transport tubes 930A and packing tubes 932A. The use of transport tubes and packing tubes as alternate flow channels for gravel slurry in general is known in the art.

In FIG. 9B, a second packer 900B is shown. The packer 900B again includes the base pipe 910. The housing 920 is concentrically disposed around the base pipe 910. An annular area 935 is formed between the base pipe 910 and the surrounding housing 920. In this arrangement, no transport tubes or packing tubes are employed; instead, the annular area 935 itself serves as an alternate flow channel 930B.

In FIG. 9C, a third packer 900C is shown. The packer 900C again includes the base pipe 910 and the surrounding housing 920. In this arrangement, shunt tubes 930C are eccentrically disposed adjacent the base pipe 910. The shunt tubes 830C reside in the annular area 935 and serve as the alternate flow channels.

In each of FIGS. 9A, 9B and 9C, the respective alternate flow channels 930A, 930B, 930C represent secondary flow paths.

The FIG. 8 series described above uses sand control devices and blank pipe as the illustrative eccentric wellbore tools, while the FIG. 9 series uses packers as the illustrative concentric wellbore tools. However, it is understood that either of these series could show a blank pipe having a primary flow path and at least one secondary flow path. Further, it is understood that the packers may have an eccentric design, and the sand control devices may have a concentric design. In any of these instances, what is needed is a crossover joint that places the primary flow paths in fluid communication and the secondary flow paths in fluid communication.

Figure 10C:
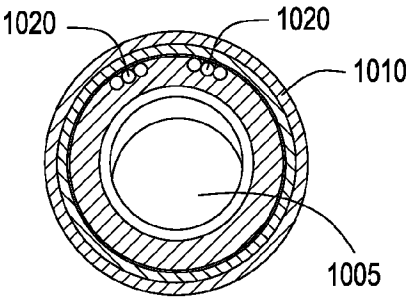
FIG. 10C is a second transverse cross-sectional view, taken across line C-C of FIG. 10A. The cut is taken at a second opposite end of the crossover joint.
Figure 10A:
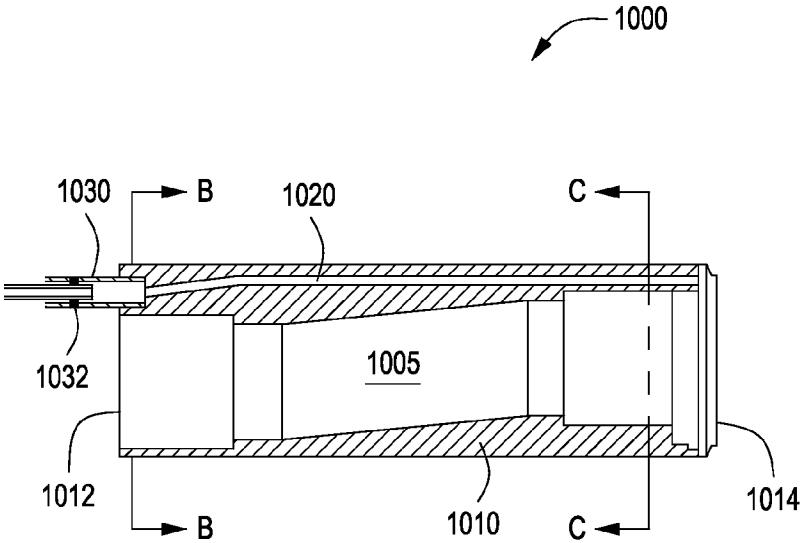
FIG. 10A provides a side, cross-sectional view of a crossover joint for connecting inner base pipes of two tubular bodies, and for providing fluid communication between eccentric and concentric secondary flow paths. The crossover joint operates to fluidly connect a first wellbore tool to a second wellbore tool.
Figure 10B:
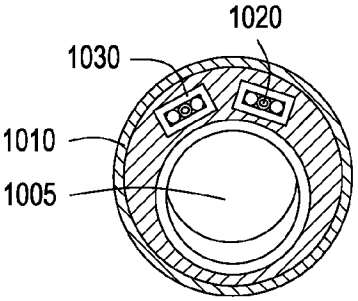
FIG. 10B is a first transverse cross-sectional view, taken across line B-B of FIG. 10A. The cut is taken at a first end of the crossover joint.

FIGS. 10A through 10C provide cross-sectional views of a crossover joint 1000. The crossover joint 1000 operates to fluidly connect a first wellbore tool to a second wellbore tool. In FIG. 10A, a side view of the crossover joint 1000 is shown. It can be seen that the crossover joint 1000 defines an elongated tubular body. The crossover joint 1000 has a wall 1010. The wall 1010 defines a bore 1005 therein. The bore 1005 serves as a curved primary flow path.

The wall 1010 has a first end 1012, and a second opposite end 1014. The bore 1005 runs the length of the crossover joint 1000 from the first end 1012 to the second end 1014. The crossover joint 1000 also has at least one secondary flow path 1020. The secondary flow path 1020 runs through the body 1010 of the crossover joint 1000, and also runs from the first end 1012 to the second end 1014.

FIG. 10B provides a first transverse cross-sectional view of the crossover joint 1000. This view is taken across line B-B of FIG. 10A. Line B-B is placed at the first end 1012 of the crossover joint 1000, which is a pin end. It can be seen from the view of FIG. 10B that the bore 1005 of the crossover joint 1000 is eccentric relative to the joint 1000 at the first end 1012. An extending connection member 1030 may be provided for fluidly connecting the secondary flow path 1020 to alternate flow channels in a sand screen or other adjacent wellbore tool.

FIG. 10C provides a second transverse cross-sectional view of the crossover joint 1000. This view is taken across line C-C of FIG. 10A. Line C-C is cut through the second end 1014 of the crossover joint 1000, which is a box end in FIG. 10A, although it could be a pin end as well. It can be seen from the view of FIG. 10C that the bore 1005 of the crossover joint 1000 is concentric relative to the joint 1000 at the second end 1014.

In the arrangement of FIGS. 10A and 10B, the first end 1012 of the crossover joint 1000 is designed to threadedly connect to or to provide fluid communication with a wellbore tool that is eccentric. Such a wellbore tool may have the profile of, for example, the sand control device 800A of FIG. 8A. Thus, the first end 1012 has an eccentric secondary flow path 1020 that aligns with pass-through rectangular ports (such as eccentric shunt tubes 830A, 832A of FIG. 8A) in the sand screen.

Reciprocally, in the arrangement of FIGS. 10A and 10C, the second end 1014 of the crossover joint 1000 is designed to threadedly connect to or to provide fluid communication with a wellbore tool that is concentric. Such a wellbore tool may have the profile of, for example, the packer 900C of FIG. 9C. Thus, the second end 1014 provides a concentric primary flow path 1005 that is connected to a packer, and a secondary flow path 1020 that connects to circular ports (such as shunt tubes 930C of FIG. 9C) in the packer.

It is noted that the eccentric wellbore tool may connect to the first end 1012 of the crossover joint 1000 either directly through a threaded connection, or indirectly through the use of a manifolding joint. Similarly, the concentric wellbore tool may connect to the second end 1014 of the crossover joint 1000 either directly through a threaded connection, or indirectly through the use of a coupling and a torque sleeve or a load sleeve. Examples of a coupling and a torque sleeve or a load sleeve are provided in U.S. Pat. No. 7,661,476 and U.S. Pat. No. 7,938,184.

It is further noted that either the eccentric wellbore tool or the concentric wellbore tool may be a sand screen, a packer, or a blank pipe. What is required is that each wellbore tool have a primary flow path and at least one secondary flow path, wherein a radial center of the primary flow path in the first wellbore tool is offset from a radial center of the primary flow path in the second wellbore tool.

The crossover joint 1000 itself also has a primary flow path 1005 and secondary flow path 1020. The secondary flow path 1020 is also curved. Preferably, the secondary flow path 1020 comprises a plurality of shunt tubes or a shunt annulus for carrying a gravel slurry. However, the secondary flow path 1020 may be of any profile.

In the arrangement of FIG. 10B, the secondary flow path 1030 is designed to fluidly communicate at the first end 1012 with the polygonal packing tubes 830A and transport tubes 832A of FIG. 8A. Similarly, in the arrangement of FIG. 10C, the secondary flow path 1020 is designed to fluidly communicate at the second end 1014 with the shunt tubes 930C of FIG. 9C. However, other fluid communication profiles may be employed at either the first end 1012 or the second end 1014.

As seen in the arrangement of FIG. 10A, the crossover joint 1000 may contain at least one inflection point along its length, providing for an "S" contour. The "S" contour compensates for the axis offset from the eccentric flow paths to the concentric flow paths. A continuous profile or contour with minimal curvature (or "dog leg") can ease downhole tool pass-through, reduce torque and drag, minimize erosion by particle flow, and minimize flow friction. A typical mathematical description of an "S" contour is a sigmoid function. Examples of sigmoid functions include, without limitation, hyperbolic tangent functions, inverse tangent functions, logistic functions, Rosin-Rammler functions, and error functions. Although the transit in the crossover joint 1000 can be as simple as a series of straight segments (without inflection point), a discontinuous profile at the turning point may pose a high local curvature.

Figure 11A:
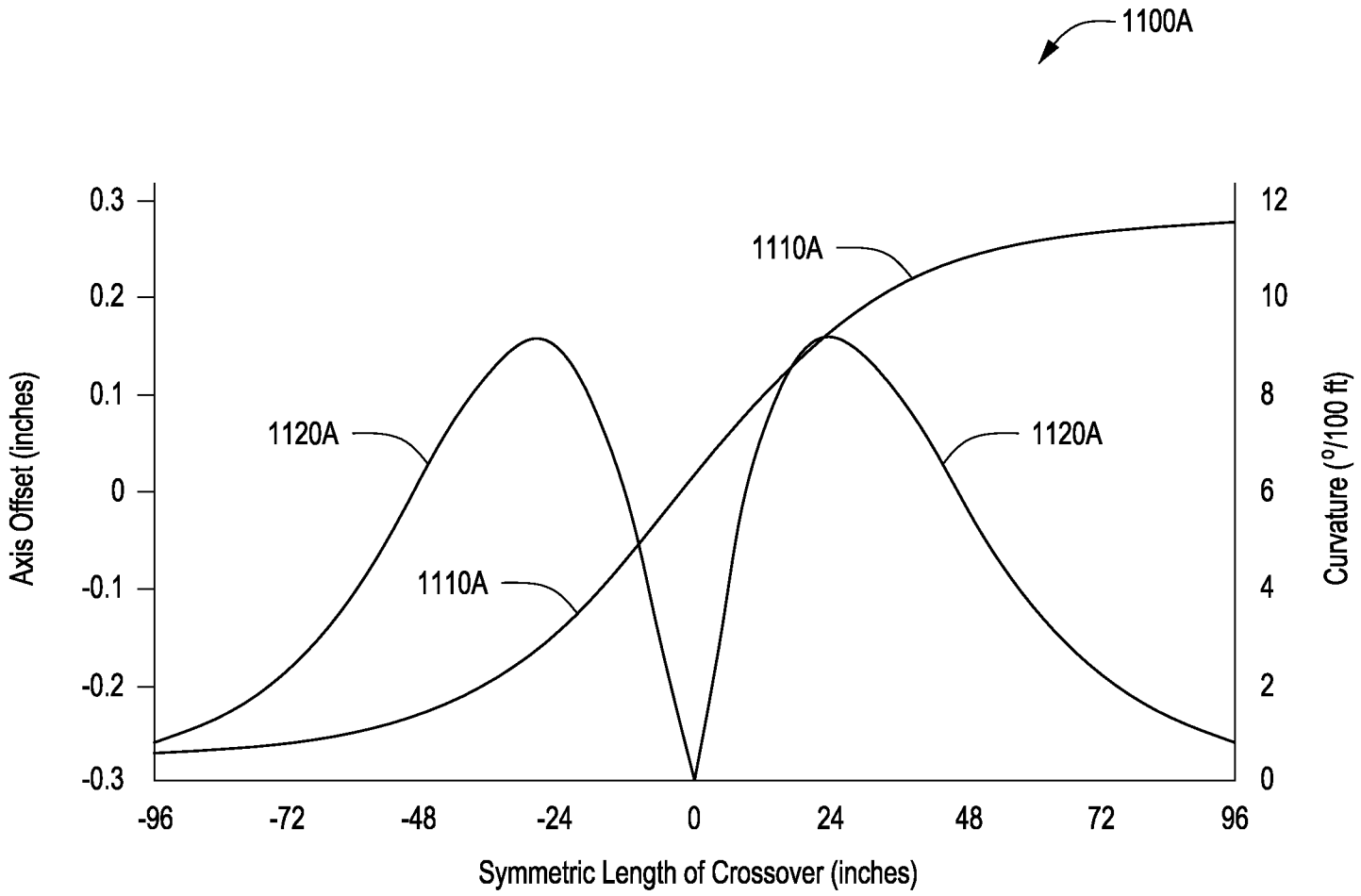
FIG. 11A is a Cartesian graph charting axis offset (first y-axis) against symmetric length of a crossover joint (x-axis) for a 16-foot crossover joint.

FIG. 11A is a Cartesian graph 1100A charting axis offset (first y-axis) against symmetric length of an illustrative crossover joint (x-axis). This is for a 16-foot crossover joint. The crossover joint illustrated in the graph 1100A of FIG. 11A has a profile for a 0.54-inch axis-offset between concentric and eccentric wellbore tools. Axis offset is indicative of curvature. Thus, line 1110A demonstrates a crossover profile and shows how the center of the bore of a crossover joint moves relative to a longitudinal center line of the tool. As can be seen, a curved or "S" profile is offered.

FIG. 11A also charts curvature (second y-axis) against symmetric length (x-axis) for the 16-foot crossover joint. Curvature is indicative of how sharply the bore of the crossover joint turns at any given location along the center of the bore. Stated mathematically, curvature is related to derivatives of the profile as it reflects rate of change of direction along the profile 1110A. This rate of change of direction is shown at line 1120A. It is noted that at the O-inches mark along the x-axis, the bore has an inflection point.

The curvature 1120A, or profile, is based on a hyperbolic tangent function. The curvature 1120A is represented by a common unit in the oil field—degree per 100 feet. The example in FIG. 11A indicates a maximum of 9°/100 ft curvature along the 192-inch (16 feet) crossover length. The curvature 1120A is zero at the middle of the crossover, or the inflection point.

The crossover length can be reduced by half, to 96 inches. This is shown in FIG. 11B.

Figure 11B:
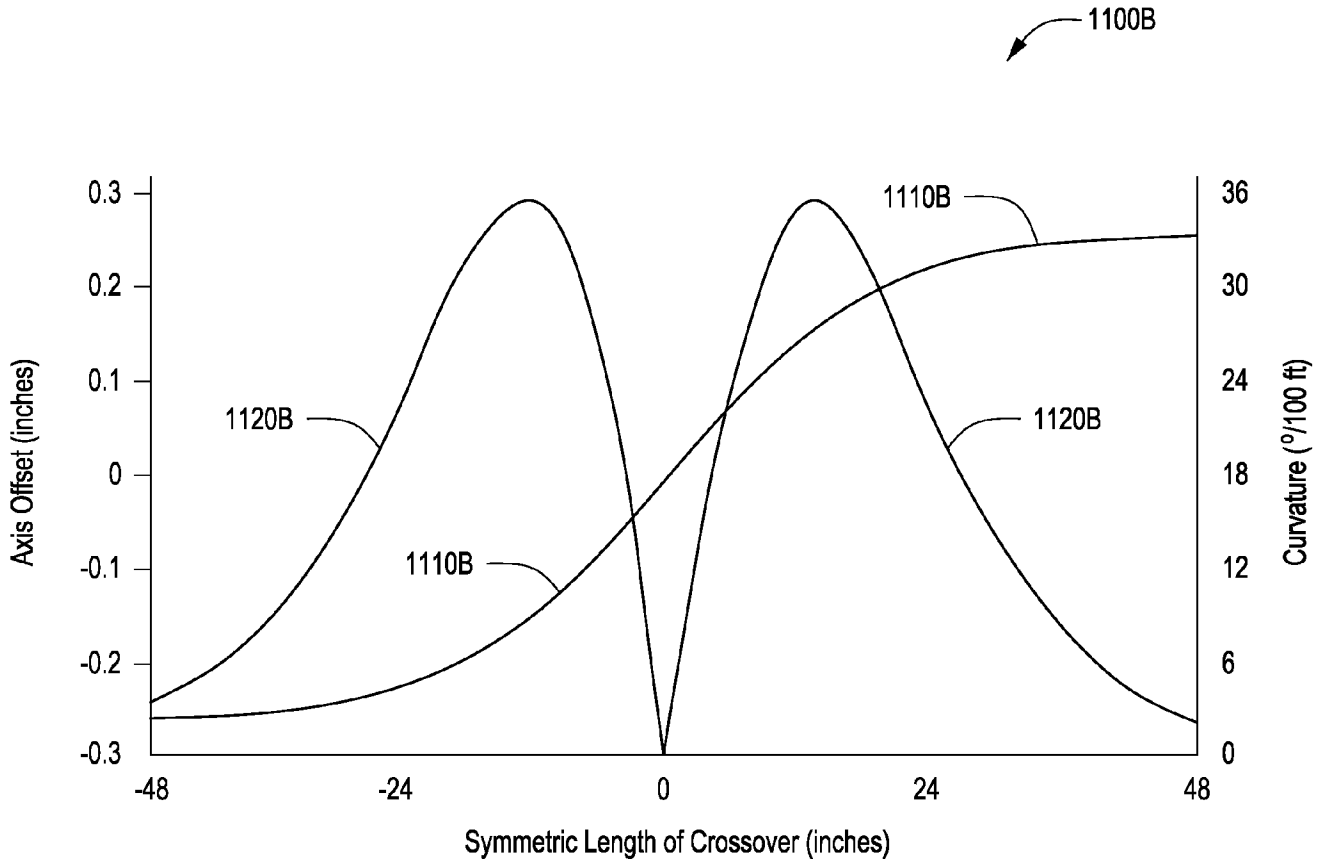
FIG. 11B is a Cartesian graph charting axis offset (first y-axis) against symmetric length of a crossover joint (x-axis) for an 8-foot crossover joint.

FIG. 11B is a Cartesian graph 1100B charting axis offset (first y-axis) against symmetric length of another illustrative crossover joint (x-axis). This is for an 8-foot crossover joint. Line 1110B demonstrates a crossover profile for the 96-inch joint, showing how the center of the bore of the crossover joint moves relative to a longitudinal center line of the tool. As can be seen, a curved profile is again offered.

FIG. 11B also charts curvature (second y-axis) against symmetric length of a crossover joint (x-axis) for the 8-foot crossover joint. Line 1120B demonstrates curvature of the bore of the crossover joint. Here, the maximum curvature is quadrupled to 36°/100 ft.

As noted above, a series of straight segments may be used in lieu of a curved profile. When a simplified geometry like straight segments is used, the crossover length may be further reduced, but the curvature at the turning (discontinuous) point(s) becomes high. Thus, the crossover design must be balanced between the length and the curvature.

Figure 11C:
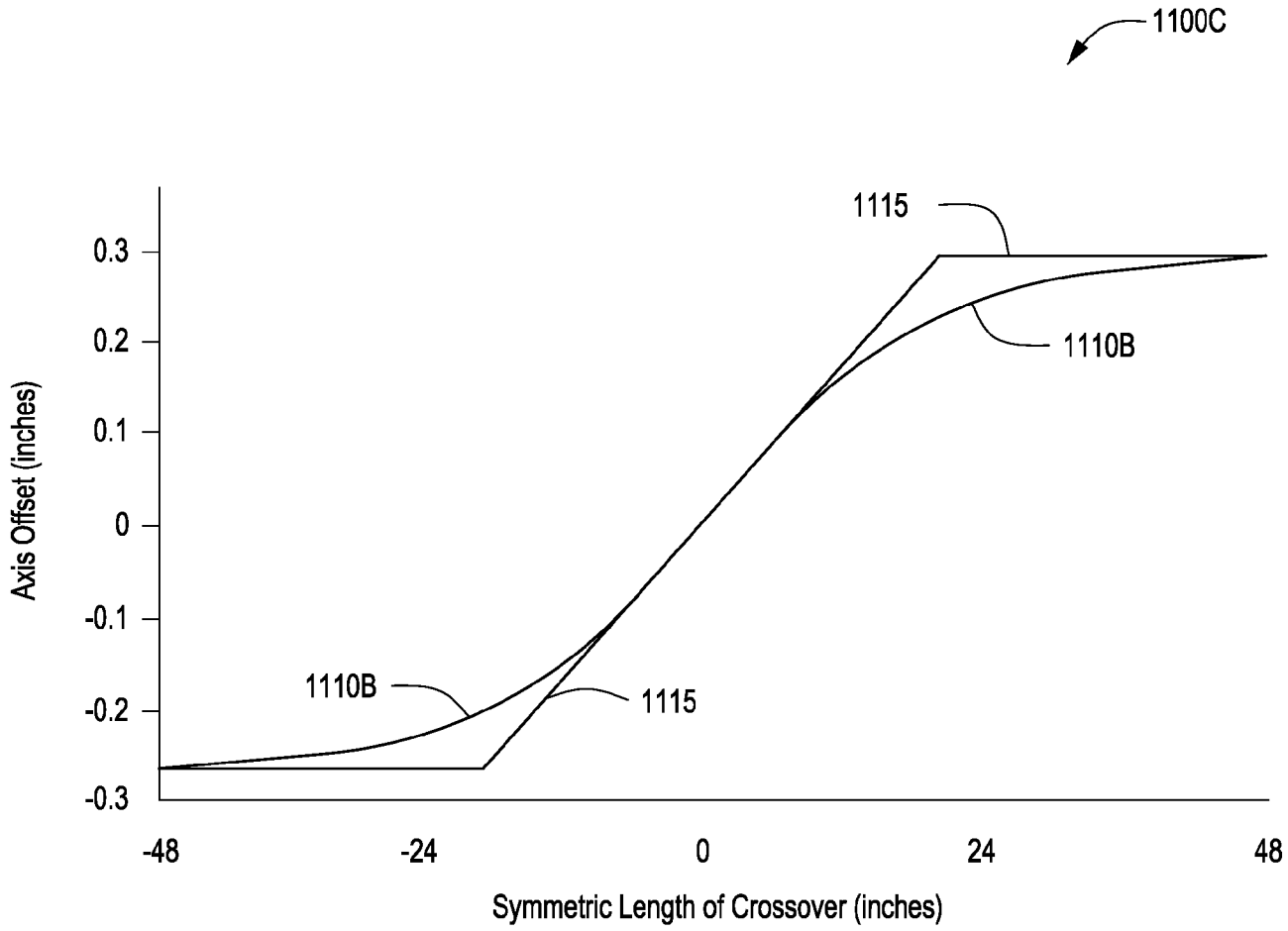
FIG. 11C is a Cartesian graph charting axis offset (y-axis) against symmetric length of a crossover joint (x-axis) for an 8-foot crossover joint. Here, the graph compares a crossover joint having a curved profile with a crossover joint having straight segments.

FIG. 11C is a Cartesian graph 1100C charting axis offset (y-axis) against symmetric length of a crossover joint (x-axis). This is also for an 8-foot crossover joint. Here, the graph 1100C compares how the center of the bore of a crossover joint moves relative to a longitudinal center line of the tool for two different bore profiles. Line 1110B is the same line as 1110B from FIG. 11B. This, again, was for a curved profile. Line 1115 is provided to show a profile having straight segments.

The axis-offset and curvature of a crossover joint 1000 are important considerations. The primary flow path of the crossover joint 1000 should be able to accommodate movement of a tool such as the setting tool 750 of FIG. 7C through the bore 1005. It can be seen that the curvature range shown at line 1120A in FIG. 11A has a smaller range than the curvature range shown at line 1120B in FIG. 11B. This is to be expected as the crossover joint of FIG. 11A has twice the length of the crossover joint of FIG. 11B, thereby reducing the "rate of change of direction" for the curvature.

Another way to mitigate the curvature impact on the primary flow path is to increase the internal diameter of the crossover joint. The increased diameter eases the run of other downhole tools through the curved crossover joint.

When using a crossover joint, other design options may be considered. For example, when the secondary flow paths serve as alternate flow channels for gravel packing, a high differential pressure can occur between the secondary flow paths and the primary flow path. Additionally, a high differential pressure may occur between the secondary flow paths and the annulus between the crossover joint and the surrounding wellbore, that is, the wellbore annulus. For example, a 6,500 psi differential pressure is expected near the heel of when gravel packing a 5,000-foot horizontal completion interval. In order to maintain the mechanical integrity (that is, to stay within the burst, bending, and collapse ratings) of the secondary flow paths, a certain surrounding wall thickness is required. This, in turn, limits the inside diameter of the crossover joint.

Other considerations include minimizing length, providing an overall outer diameter that is less than or equal to the diameters of the adjacent wellbore tools, maximizing inner diameter of the primary flow path, and providing an overall mechanical integrity that is equal to or greater than that of the adjacent tools.

Figure 12:
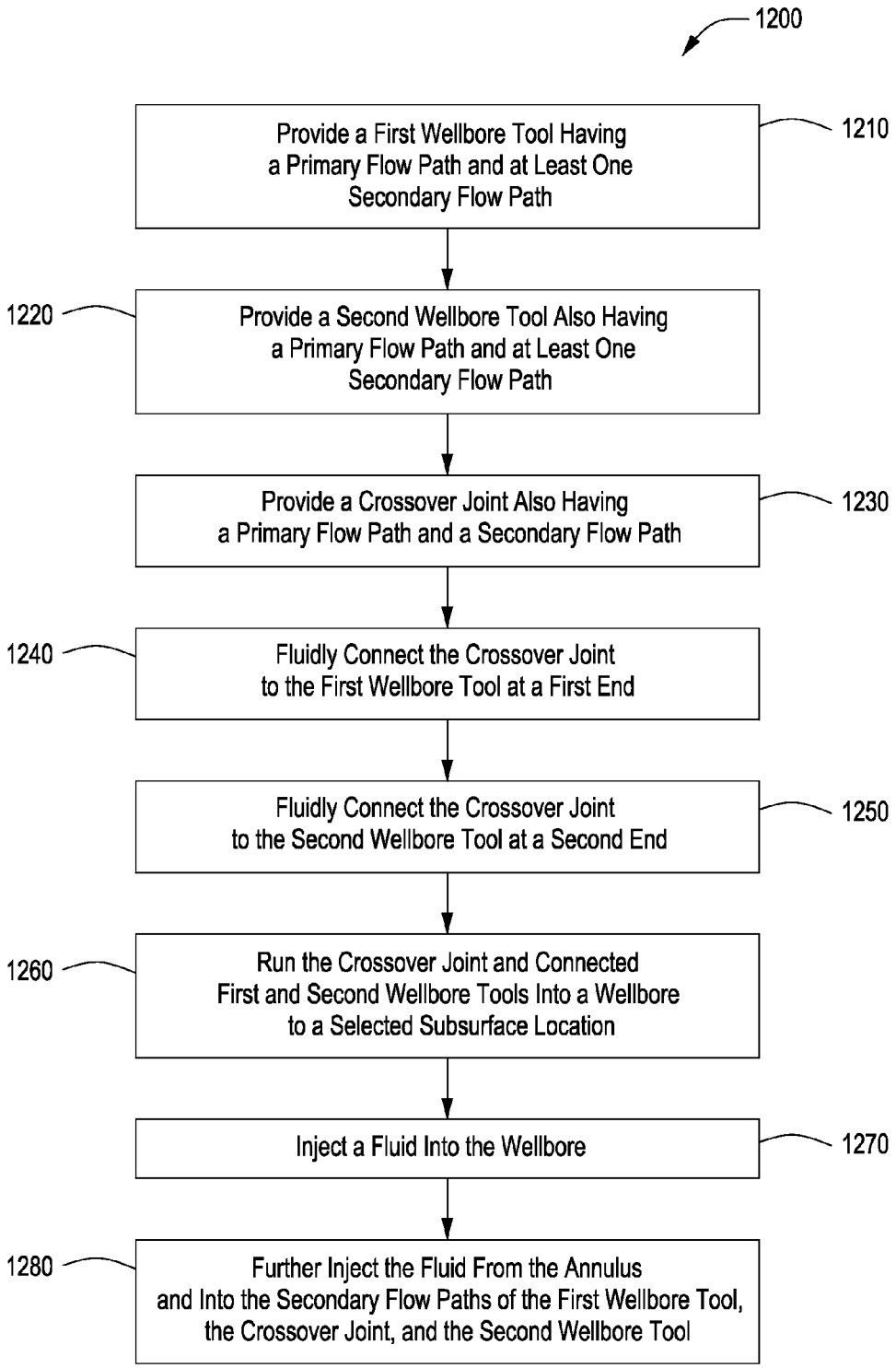
FIG. 12 is a flow chart showing steps for a method for completing a wellbore in a subsurface formation, in one embodiment.

FIG. 12 is a flow chart showing steps for a method 1200 for completing a wellbore in a subsurface formation, in one embodiment. The method 1200 is applicable for the installation of wellbore tools having flow paths that do not align.

In one aspect, the method 1200 first comprises providing a first wellbore tool. This is shown at Box 1210. The first wellbore tool has a primary flow path and at least one secondary flow path. The first wellbore tool may be a sand screen, a packer, or a blank pipe.

The method 1200 also includes providing a second wellbore tool. This is indicated at Box 1220. The second wellbore tool also has a primary flow path and at least one secondary flow path. The second wellbore tool may be a sand screen, a packer, or a blank pipe. However, a radial center of the primary flow path of the first wellbore tool is offset from a radial center of the primary flow path for the second wellbore tool.

The method 1200 also includes providing a crossover joint. This is shown at Box 1230. The crossover joint also comprises a primary flow path and at least one secondary flow path. The method 1200 then includes fluidly connecting the crossover joint to the first wellbore tool at a first end, and fluidly connecting the crossover joint to the second wellbore tool at a second end. These steps are provided at Boxes 1240 and 1250, respectively. In this manner, the primary flow path of the first wellbore tool is in fluid communication with the primary flow path of the second wellbore tool. Further, the at least one secondary flow path of the first wellbore tool is in fluid communication with the at least one secondary flow path of the second wellbore tool.

The method 1200 further includes running the crossover joint and connected first and second wellbore tools into a wellbore. This is seen at Box 1260. The crossover joint is run to a selected subsurface location within the wellbore. Fluid is then injected into the wellbore. This is shown at Box 1270.

The method 1200 then includes further injecting the fluid from the wellbore and through the secondary flow paths of the first wellbore tool, the crossover joint, and the secondary flow paths for the second wellbore tool. This is provided at Box 1280.

The crossover joint may be used to connect any two tubular tools having primary flow paths and secondary flow paths, wherein a radial center of the primary flow path in the first wellbore tool is offset from a radial center of the primary flow path in the second wellbore tool. However, it is preferred that the crossover joint be used as part of a sand control system. In this instance, the first wellbore tool is preferably a sand screen, while the second wellbore tool is preferably a mechanically-set packer, such as packer 600 of FIGS. 6A and 6B.

In one embodiment, the primary flow path of the first wellbore tool (such as a sand screen) is eccentric to the first wellbore tool, while the primary flow path of the second wellbore tool (such as a packer) is concentric to the second wellbore tool. In this instance, a base pipe serves as the primary flow path of the sand screen, while an elongated inner mandrel serves as the primary flow path of the packer. The secondary flow path for the sand screen is made up of shunt tubes which serve as alternate flow channels. The secondary flow path for the packer may be shunt tubes or may be an annular area formed between the inner mandrel and a surrounding moveable piston housing. In any instance, the alternate flow channels allow a gravel slurry to bypass the sand screen joint, the crossover joint, and the packer, even after the packer has been set in the wellbore.

In one aspect, the method 1200 further comprises setting the packer in the wellbore. In this instance, the step of further injecting the fluid through the secondary flow paths is done after the packer has been set.

Figure 13:
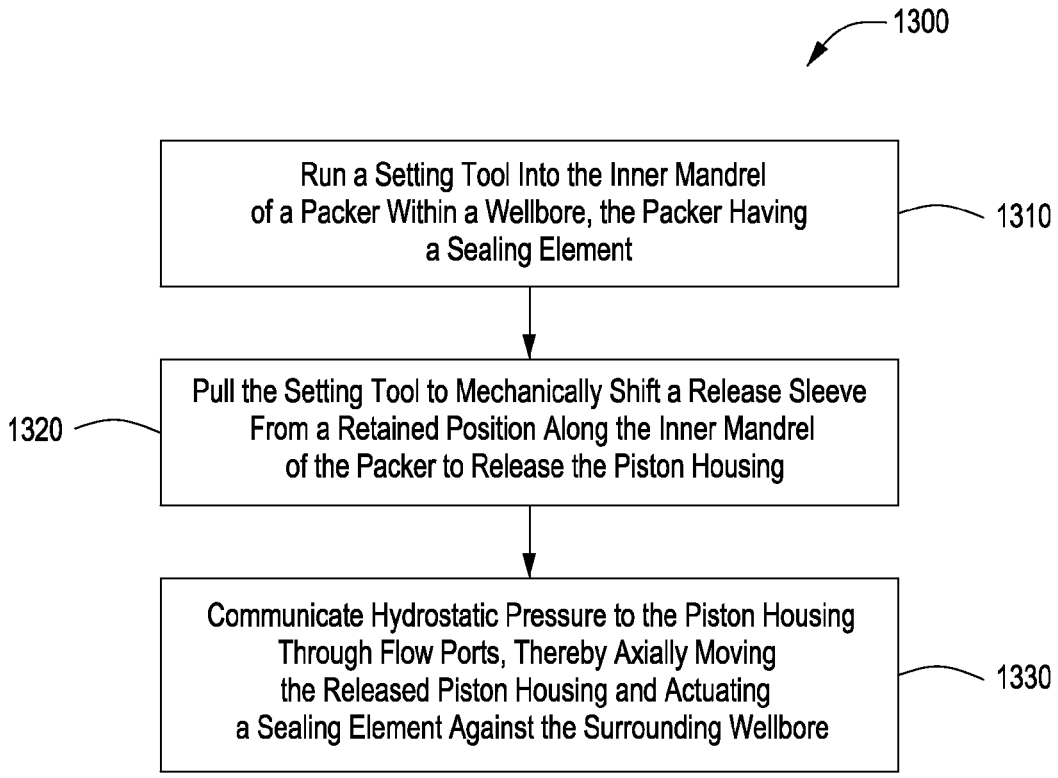
FIG. 13 is another flow chart.

FIG. 13 is a flow chart that shows steps for a method 1300 of setting a packer in a wellbore, in one embodiment. The packer is designed in accordance with the packer 600 of FIGS. 6A and 6B. The method 1300 first includes running a setting tool into the inner mandrel of the packer. This is shown in Box 1310.

The setting tool is advanced beyond the depth of the packer. The method 1300 then includes pulling the setting to back up the wellbore. This is seen at Box 1320. The setting tool has a collet fingers or other raised surfaces that catch on a release sleeve. As the setting tool is pulled up the wellbore, the collet fingers latch into a release sleeve. Pulling the setting tool mechanically shifts the release sleeve from a retained position along the inner mandrel of the packer. This, in turn, releases a piston housing in the packer for axial movement.

The method 1300 then includes communicating hydrostatic pressure to the piston housing. This is provided at Box 1330. Communication of hydrostatic pressure is conducted through one or more flow ports. The flow ports are exposed to wellbore fluids when the release sleeve is translated. The piston housing has a pressure-bearing surface that is acted on by the hydrostatic pressure. This causes axial movement of the released piston housing, and in turn actuates the sealing element against the surrounding wellbore.

The preferred embodiment for using a crossover joint offers the following tool sequence:

eccentric screen→crossover tool→concentric packer

A variation of this sequence is as follows:

eccentric screen→crossover tool→concentric packer→crossover tool→eccentric screen However, the order of tool connections is not confined to using an eccentric sand screen and a concentric packer. If a concentric packer is not available, the operator may choose to use the following tool sequence:

concentric screen→crossover tool→eccentric packer→crossover tool→concentric screen Thus, the crossover joint allows a change in the orientation of the base pipes and the eccentric shunt tubes along a series of sand screens. In this case, two crossover joints are needed. The first crossover joint preferably has a concentric box end and an eccentric pin end. The second crossover joint preferably has an eccentric box end and a concentric pin end. A certain type of packer may actually be desirable in some circumstances. If, for example, a particular type of packer allows a higher hydrostatic pressure or higher pressure ratings in shunt flow paths, then that packer may be selected.

Another tool sequence for use with a crossover joint is:

concentric screen→crossover tool→eccentric screen

The use of concentric screens may be beneficial when gravel packing long intervals. Concentric sand screens can be more robust for gravel packing long intervals. For example, known concentric screens are capable of gravel packing 5,000 feet, compared to 3,000 feet with the commercial eccentric screens. The new crossover tool allows the operator to use the less-expensive eccentric screens on the toe or lower-pressure side of the interval during gravel-packing operations, and to use the concentric screens on the heel or higher-pressure side of the interval during the gravel-packing operations. This reduces the overall cost of completion while still achieving the gravel packing goal.

It may be difficult to acquire more complex concentric sand screens in quantities needed for extended horizontal completions. Therefore, the crossover joint allows a horizontal completion to continue without delay by combining concentric screens with the more readily available eccentric screens. Thus, the use of crossover joints provides flexibility in maintaining and managing the inventory of sand screens.

The crossover joint also provides the operator flexibility in using the best screens for a particular interval, or the best performing packer for zonal isolation. The operator is not constrained by matching the flow paths of screens with packers, and may take advantage of the best wellbore tools available for the job.

The crossover joint also allows the operator to be creative with the use of blank pipes. For example, the crossover joint permits the use of concentric round shunt tubes on blank pipe joints above the eccentric screens in multi-zone frac pack applications. The concentric round shunt tubes allow for higher fluid injection pressures. The crossover joint enables fluid connectivity between and eccentric sand screen joint and the concentric blank pipe.

As can be seen, a wellbore apparatus is provided herein. The wellbore apparatus may generally be claimed as in the following sub-paragraphs:

1. A wellbore apparatus comprising:

a first wellbore tool having a primary flow path and at least one secondary flow path;

a second wellbore tool also having a primary flow path and at least one secondary flow path, wherein a radial center of the primary flow path in the first wellbore tool is offset from a radial center of the primary flow path in the second wellbore tool; and a crossover joint for connecting the first wellbore tool to the second wellbore tool, the crossover joint comprising:

a primary flow path fluidly connecting the primary flow path of the first wellbore tool to the primary flow path of the second wellbore tool; and at least one secondary flow path fluidly connecting the at least one secondary flow path of the first wellbore tool to the at least one secondary flow path of the second wellbore tool.

2. The wellbore apparatus of sub-paragraph 1 wherein:

the primary flow path in the crossover joint is eccentric to the crossover joint at a first end; and the primary flow path in the crossover joint is concentric to the crossover joint at a second opposite end.

3. The wellbore apparatus of sub-paragraph 2, wherein the primary flow path in the crossover joint has a profile of a sigmoid function.

4. The wellbore apparatus of sub-paragraph 2, wherein the primary flow path in the crossover joint comprises at least two linear segments.

5. The wellbore apparatus of sub-paragraph 1 or sub-paragraph 2, wherein:

the wellbore apparatus is a sand control device;

the first wellbore tool is a sand screen that comprises an elongated base pipe, a filtering medium circumferentially around the base pipe, and at least one shunt tube along the base pipe serving as an alternate flow channel, the at least one shunt tube being configured to allow gravel slurry to at least partially bypass the first wellbore tool during a gravel-packing operation in a wellbore;

the base pipe serves as the primary flow path of the sand screen; and the at least one shunt tube serves as the at least one secondary flow path of the sand screen.

6. The wellbore apparatus of sub-paragraph 5, wherein:

the at least one shunt tube is internal to the filtering medium, or is external to the filtering medium.

7. The wellbore apparatus of sub-paragraph 6, wherein:

each of the at least one shunt tube has a round profile, a square profile, or a rectangular profile; and the elongated base pipe is eccentric to the sand screen.

8. The wellbore apparatus of sub-paragraph 7, wherein the first wellbore tool further comprises a perforated outer protective shroud around the at least one shunt tube.

9. The wellbore apparatus of sub-paragraph 1 or sub-paragraph 2, wherein:

the second wellbore tool is a packer, the packer comprising an elongated inner mandrel, a sealing element external to the inner mandrel, and an annular region serving as an alternate flow channel, the annular region being configured to allow gravel slurry to at least partially bypass the second wellbore tool during a gravel-packing operation in a wellbore after the packer has been set in the wellbore;

the inner mandrel serves as the primary flow path of the packer; and the annular region serves as the at least one secondary flow path of the packer.

10. The wellbore apparatus of sub-paragraph 9, wherein the inner mandrel is concentric to the packer.

11. The wellbore apparatus of sub-paragraph 9, wherein the primary flow path has a profile of a sigmoid function.

12. The wellbore apparatus of sub-paragraph 1 or sub-paragraph 2, wherein:

the first wellbore tool is a blank pipe that comprises an elongated base pipe and at least one shunt tube along the base pipe serving as an alternate flow channel, the at least one shunt tube being configured to allow gravel slurry to at least partially bypass the first wellbore tool during a gravel-packing operation in a wellbore;

the base pipe serves as the primary flow path of the blank pipe; and the at least one shunt tube serves as the at least one secondary flow path of the blank pipe.

13. The wellbore apparatus of sub-paragraph 5, wherein:

the second wellbore tool is a packer, the packer comprising an elongated inner mandrel, a sealing element external to the inner mandrel, and an annular region serving as an alternate flow channel, the annular region being configured to allow gravel slurry to at least partially bypass the second wellbore tool during a gravel-packing operation in a wellbore after the packer has been set in the wellbore;

the inner mandrel serves as the primary flow path of the packer; and the annular region serves as the at least one secondary flow path of the packer.

14. The wellbore apparatus of sub-paragraph 13, wherein:

the elongated base pipe of the sand screen is eccentric to the sand screen; and the inner mandrel of the packer is concentric to the packer.

15. The wellbore apparatus of sub-paragraph 5, wherein:

the second wellbore tool is also a sand screen that comprises an elongated base pipe, a filtering medium circumferentially around the base pipe, and at least one shunt tube along the base pipe serving as an alternate flow channel, the at least one shunt tube being configured to allow gravel slurry to at least partially bypass the second wellbore tool during a gravel-packing operation in a wellbore;

the elongated base pipe of the sand screen representing the first wellbore tool is concentric to the sand screen; and the elongated base pipe of the sand screen representing the second wellbore tool is eccentric to the sand screen.

While it will be apparent that the inventions herein described are well calculated to achieve the benefits and advantages set forth above, it will be appreciated that the inventions are susceptible to modification, variation and change without departing from the spirit thereof. Improved methods for completing an open-hole wellbore are provided, which use a crossover tool for fluidly connecting an eccentric flow path to a concentric flow path.

What is claimed is:

1. A crossover joint for connecting a first wellbore tool to a second wellbore tool, the first wellbore tool having a primary flow path and at least one secondary flow path, and the second wellbore tool having a primary flow path and at least one secondary flow path, the crossover joint comprising:

a first end for connecting to the first wellbore tool and a second end for connecting to the second wellbore tool;

a primary flow path configured to fluidly connect the primary flow path of the first wellbore tool to the primary flow path of the second wellbore tool; and at least one secondary flow path configured to fluidly connect the at least one secondary flow path of the first wellbore tool to the at least one secondary flow path of the second wellbore tool;

wherein a radial center of the primary flow path in the first wellbore tool at a connection to the first end of the crossover joint is offset from a radial center of the primary flow path in the second wellbore tool at a connection to the second end of the crossover joint; and wherein the primary flow path in the crossover joint is eccentric to the crossover joint at a first end, and the primary flow path in the crossover joint is concentric to the crossover joint at a second end.

2. The crossover joint of claim 1, wherein the primary flow path in the crossover joint has a profile of a sigmoid function.

3. The crossover joint of claim 1, wherein the primary flow path in the crossover joint changes direction along a longitudinal axis of the crossover joint at least once.

4. The crossover joint of claim 3, wherein the primary flow path in the crossover joint comprises at least two linear segments.

5. The crossover joint of claim 3, wherein the at least one secondary flow path of the crossover joint changes direction along a longitudinal axis of the crossover joint at least once.

6. A wellbore apparatus comprising:

a first wellbore tool having a primary flow path and at least one secondary flow path;

a second wellbore tool also having a primary flow path and at least one secondary flow path; and a crossover joint for connecting the first wellbore tool to the second wellbore tool, the crossover joint comprising:

a first end for connecting to the first wellbore tool and a second end for connecting to the second wellbore tool;

a primary flow path fluidly connecting the primary flow path of the first wellbore tool to the primary flow path of the second wellbore tool; and at least one secondary flow path fluidly connecting the at least one secondary flow path of the first wellbore tool to the at least one secondary flow path of the second wellbore tool;

wherein a radial center of the primary flow path in the first wellbore tool at a connection of the second end of the first wellbore tool to the first end of the crossover joint is offset from a radial center of the primary flow path in the second wellbore tool at a connection of the first end of the second wellbore tool to the second end of the crossover joint; and wherein the primary flow path for the first wellbore tool at the second end of the first wellbore tool is concentric with respect to a radial center of the first wellbore tool and the primary flow path of the second wellbore tool at the first end of the second wellbore tool is eccentric with respect to the radial center of the second wellbore tool.

7. The wellbore apparatus of claim 6, wherein:

the primary flow path in the crossover joint is eccentric to the crossover joint at a first end; and the primary flow path in the crossover joint is concentric to the crossover joint at a second end.

8. The wellbore apparatus of claim 7, wherein the primary flow path in the crossover joint has a profile of a sigmoid function.

9. The wellbore apparatus of claim 7, wherein the primary flow path in the crossover joint changes direction along a longitudinal axis of the crossover joint at least once.

10. The wellbore apparatus of claim 9, wherein the primary flow path in the crossover joint comprises at least two linear segments.

11. The wellbore apparatus of claim 9, wherein the at least one secondary flow path of the crossover joint changes direction along a longitudinal axis of the crossover joint at least once.

12. The wellbore apparatus of claim 7, wherein the primary flow path of the first wellbore tool is eccentric to the first wellbore tool.

13. The wellbore apparatus of claim 7, wherein the primary flow path of the second wellbore tool is concentric to the second wellbore tool.

14. The wellbore apparatus of claim 7, wherein the at least one secondary flow path of the first wellbore tool is eccentric to the first wellbore tool.

15. The wellbore apparatus of claim 7, wherein the primary flow in the crossover tool has a profile of a sigmoid function.

16. The wellbore apparatus of claim 7, wherein an inner diameter of the primary flow path of the crossover joint is greater than an inner diameter of (i) the primary flow path of the first wellbore tool, (ii) the primary flow path of the second wellbore tool, or (iii) both.

17. The wellbore apparatus of claim 6, wherein:

the wellbore apparatus is a sand control device;

the first wellbore tool is a sand screen that comprises an elongated base pipe, a filtering medium circumferentially around the base pipe, and at least one shunt tube along the base pipe serving as an alternate flow channel, the at least one shunt tube being configured to allow gravel slurry to at least partially bypass the first wellbore tool during a gravel-packing operation in a wellbore;

the base pipe serves as the primary flow path of the sand screen; and the at least one shunt tube serves as the at least one secondary flow path of the sand screen.

18. The wellbore apparatus of claim 17, wherein:

the at least one shunt tube is internal to the filtering medium.

19. The wellbore apparatus of claim 17, wherein:

the at least one shunt tube is external to the filtering medium.

20. The wellbore apparatus of claim 19, wherein:

each of the at least one shunt tube has a round profile, a square profile, or a rectangular profile; and the elongated base pipe is eccentric to the sand screen.

21. The wellbore apparatus of claim 20, wherein the first wellbore tool further comprises a perforated outer protective shroud around the at least one shunt tube.

22. The wellbore apparatus of claim 17, wherein:

the second wellbore tool is a packer, the packer comprising an elongated inner mandrel, a sealing element external to the inner mandrel, and an annular region serving as an alternate flow channel, the annular region being configured to allow gravel slurry to at least partially bypass the second wellbore tool during a gravel-packing operation in a wellbore after the packer has been set in the wellbore;

the inner mandrel serves as the primary flow path of the packer; and the annular region serves as the at least one secondary flow path of the packer.

23. The wellbore apparatus of claim 22, wherein:

the elongated base pipe of the sand screen is eccentric to the sand screen; and the inner mandrel of the packer is concentric to the packer.

24. The wellbore apparatus of claim 22, wherein:

the elongated base pipe of the sand screen is concentric to the sand screen; and the inner mandrel of the packer is eccentric to the packer.

25. The wellbore apparatus of claim 17, wherein:

the second wellbore tool is also a sand screen that comprises an elongated base pipe, a filtering medium circumferentially around the base pipe, and at least one shunt tube along the base pipe serving as an alternate flow channel, the at least one shunt tube being configured to allow gravel slurry to at least partially bypass the second wellbore tool during a gravel-packing operation in a wellbore;

the elongated base pipe of the sand screen representing the first wellbore tool is concentric to the sand screen; and the elongated base pipe of the sand screen representing the second wellbore tool is eccentric to the sand screen.

26. The wellbore apparatus of claim 6, wherein:

the second wellbore tool is a packer, the packer comprising an elongated inner mandrel, a sealing element external to the inner mandrel, and an annular region serving as an alternate flow channel, the annular region being configured to allow gravel slurry to at least partially bypass the second wellbore tool during a gravel-packing operation in a wellbore after the packer has been set in the wellbore;

the inner mandrel serves as the primary flow path of the packer; and the annular region serves as the at least one secondary flow path of the packer.

27. The wellbore apparatus of claim 26, wherein the inner mandrel is concentric to the packer.

28. The wellbore apparatus of claim 27, wherein the crossover joint is connected to the packer by means of:

a load sleeve external to the primary flow path at or near a first end, with at least one bored channel through and fluidly connected to the at least one secondary flow path; or a torque sleeve external to the primary flow path at near a second opposite end with at least one bored channel through and fluidly connected to the at least one secondary flow path.

29. The wellbore apparatus of claim 26, wherein the annular region is eccentric to the packer.

30. The wellbore apparatus of claim 26, wherein the packer further comprises:

a release sleeve along an inner surface of the inner mandrel, the packer being configured so that shifting the release sleeve shears at least one shear pin along the inner mandrel;

a movable piston housing retained around the inner mandrel, with the annular region being formed between the inner mandrel and the surrounding piston housing; and one or more flow ports providing fluid communication between the annular region and a pressure-bearing surface of the piston housing after the release sleeve has been shifted.

31. The wellbore apparatus of claim 26, wherein the sealing element of the packer is an elastomeric cup-type element.

32. The wellbore apparatus of claim 6, wherein:

the first wellbore tool is a blank pipe that comprises an elongated base pipe and at least one shunt tube along the base pipe serving as an alternate flow channel, the at least one shunt tube being configured to allow gravel slurry to at least partially bypass the first wellbore tool during a gravel-packing operation in a wellbore;

the base pipe serves as the primary flow path of the blank pipe; and the at least one shunt tube serves as the at least one secondary flow path of the blank pipe.

33. A method for completing a wellbore in a subsurface formation, the method comprising:

providing a first wellbore tool, the first wellbore tool having a first end and a second end, a primary flow path and at least one secondary flow path;

providing a second wellbore tool also comprising a first end and a second end, a primary flow path and at least one secondary flow path, wherein a radial center of the primary flow path in the second end of the first wellbore tool is offset from a radial center of the primary flow path in the first end of the second wellbore tool; and providing a crossover joint, the crossover joint also comprising a primary flow path and at least one secondary flow path, and a first end for connecting with the second end of the first wellbore tool and a second end for connecting with the first end of the second wellbore tool wherein a radial center of the primary flow path in the second end of the first wellbore tool at a connection of the second end of the first wellbore tool to the first end of the crossover joint is offset from a radial center of the primary flow path in the first end of the second wellbore tool at a connection of the first end of the second wellbore tool to the second end of the crossover joint; and wherein the primary flow path for the first wellbore tool at the second end of the first wellbore tool is concentric with respect to a radial center of the first wellbore tool and the primary flow path of the second wellbore tool at the first end of the second wellbore tool is eccentric with respect to the radial center of the second wellbore tool; and fluidly connecting the first end of the crossover joint to the second end of the first wellbore tool and fluidly connecting second end of the crossover joint to the first end of the second wellbore tool, such that the primary flow path of the first wellbore tool is in fluid communication with the primary flow path of the second wellbore tool, and the at least one secondary flow path of the first wellbore tool is in fluid communication with the at least one secondary flow path of the second wellbore tool;

running the crossover joint and connected first and second wellbore tools into a wellbore to a selected subsurface location, and thereby forming an annulus in the wellbore between the crossover joint and the surrounding wellbore;

injecting a fluid into the wellbore; and further injecting the fluid from the wellbore and into the secondary flow paths of the first wellbore tool, the crossover joint, and the secondary flow paths of the second wellbore tool.

34. The method of claim 33, wherein:

the fluid is a gravel slurry for forming a gravel pack;

the first wellbore tool is a sand screen that comprises an elongated base pipe, a filtering medium circumferentially around the base pipe, and at least one shunt tube along the base pipe serving as an alternate flow channel, the at least one shunt tube being configured to allow gravel slurry to at least partially bypass the first wellbore tool during a gravel-packing operation in a wellbore;

the base pipe serves as the primary flow path of the sand screen; and the at least one shunt tube serves as the at least one secondary flow path of the sand screen.

35. The method of claim 34, wherein the base pipe of the sand screen is eccentric to the sand screen.

36. The method of claim 34, wherein the primary flow path of the second wellbore tool is concentric to the second wellbore tool.

37. The method of claim 34, wherein:

the at least one secondary flow path of the sand screen is eccentric to the sand screen.

38. The method of claim 34, wherein the at least one shunt tube is internal to the filtering medium.

39. The method of claim 34, wherein the at least one shunt tube is external to the filtering medium.

40. The method of claim 34, wherein:

each of the at least one shunt tube has a round profile, a square profile, or a rectangular profile; and the elongated base pipe is eccentric to the sand screen.

41. The method of claim 34, wherein:

the second wellbore tool is a packer, the packer comprising an elongated inner mandrel, a sealing element external to the inner mandrel, and an annular region serving as an alternate flow channel, the annular region being configured to allow gravel slurry to at least partially bypass the second wellbore tool during a gravel-packing operation in a wellbore after the packer has been set in the wellbore;

the inner mandrel serves as the primary flow path of the packer; and the annular region serves as the at least one secondary flow path of the packer.

42. The method of claim 41, further comprising:

setting the packer in the wellbore; and wherein further injecting the fluid through the secondary flow paths is done after the packer has been set.

43. The method of claim 42, wherein the inner mandrel is concentric to the packer.

44. The method of claim 43, wherein:

injecting a fluid into the wellbore comprises injecting a gravel slurry as part of a gravel-packing operation; and further injecting the fluid through the secondary flow paths comprises injecting the gravel slurry through the alternate flow channels to allow the gravel slurry to at least partially bypass the sealing element so that the wellbore is gravel-packed below the packer after the packer has been set in the wellbore.

45. The method of claim 42, wherein setting the packer comprises:

running a setting tool into the inner mandrel of the packer;

pulling the setting tool to mechanically shift a release sleeve from a retained position along the inner mandrel of the packer, thereby releasing the piston housing for axial movement; and communicating hydrostatic pressure to the piston housing through the one or more flow ports, thereby axially moving the released piston housing and actuating the sealing element against the surrounding wellbore.

46. The method of claim 45, wherein the packer further comprises:

a release sleeve along an inner surface of the inner mandrel, the packer being configured so that shifting the release sleeve shears at least one shear pin along the inner mandrel;

a movable piston housing retained around the inner mandrel, with the annular region being formed between the inner mandrel and the surrounding piston housing; and one or more flow ports providing fluid communication between the annular region and a pressure-bearing surface of the piston housing after the release sleeve has been shifted.

47. The method of claim 46, wherein:

running the setting tool comprises running a washpipe into a bore within the inner mandrel of the packer, the washpipe having the setting tool thereon; and releasing a movable piston housing from its retained position by pulling the washpipe with the setting tool along the inner mandrel, thereby shifting a release sleeve and shearing the at least one shear pin, and thereby releasing the piston housing for axial movement along the inner mandrel.

48. The method of claim 41, wherein the annular region is eccentric to the packer.

49. The method of claim 34, wherein during the injecting step, the at least one secondary flow path in the crossover joint has a fluid pressure that is higher than a fluid pressure in the primary flow path of the crossover joint.

50. The method of claim 33, wherein during the injecting step, the at least one secondary flow path in the crossover joint has a fluid pressure that is higher than a fluid pressure in the wellbore annulus.

51. The method of claim 33, wherein the at least one secondary flow path in the first wellbore tool is connected to the at least one secondary flow path in the crossover joint by means of a manifold.

52. The method of claim 33, wherein the wellbore is completed to have an open hole portion along the selected subsurface location.

* * * * *